US009368056B2

(12) United States Patent
Washio

(10) Patent No.: US 9,368,056 B2
(45) Date of Patent: Jun. 14, 2016

(54) DISPLAY DEVICE

(75) Inventor: Hajime Washio, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 11 days.

(21) Appl. No.: 13/583,086

(22) PCT Filed: Apr. 7, 2011

(86) PCT No.: PCT/JP2011/058764

§ 371 (c)(1),
(2), (4) Date: Sep. 6, 2012

(87) PCT Pub. No.: WO2011/152120

PCT Pub. Date: Dec. 8, 2011

(65) Prior Publication Data

US 2013/0002626 A1 Jan. 3, 2013

(30) Foreign Application Priority Data

Jun. 1, 2010 (JP) ..... 2010-125548

(51) Int. Cl.
*G09G 3/20* (2006.01)
*G09G 3/36* (2006.01)

(52) U.S. Cl.
CPC ..... *G09G 3/2085* (2013.01); *G09G 3/3648* (2013.01); *G09G 3/3614* (2013.01); *G09G 2300/0857* (2013.01); *G09G 2330/021* (2013.01)

(58) Field of Classification Search
CPC . G09G 3/3685; G09G 3/3614; G09G 3/3648; G09G 3/3688; G09G 2330/021; G09G 3/2048
See application file for complete search history.

(56) References Cited

U.S. PATENT DOCUMENTS

| | | | | |
|---|---|---|---|---|
| 4,464,789 | A * | 8/1984 | Sternberg | 382/291 |
| 4,996,523 | A | 2/1991 | Bell et al. | |
| 5,945,972 | A | 8/1999 | Okumura et al. | |
| 2001/0011987 | A1 * | 8/2001 | Kubota et al. | 345/98 |
| 2002/0175909 | A1 * | 11/2002 | Matsumoto | 345/211 |
| 2003/0011552 | A1 | 1/2003 | Ishii et al. | |

(Continued)

FOREIGN PATENT DOCUMENTS

| | | | |
|---|---|---|---|
| JP | 02-148687 | A | 6/1990 |
| JP | 10-74064 | A | 3/1998 |

(Continued)

OTHER PUBLICATIONS

Official Communication issued in International Patent Application No. PCT/JP2011/058764, mailed on Jun. 28, 2011.

(Continued)

*Primary Examiner* — Kent Chang
*Assistant Examiner* — Sujit Shah
(74) *Attorney, Agent, or Firm* — Keating & Bennett, LLP

(57) ABSTRACT

In a pixel memory portion of a display device, as corresponding to each pixel memory unit, there are provided a flip-flop, a voltage selection portion, which selects either white display voltage or black display voltage in accordance with an output signal from the flip-flop, and a liquid crystal capacitance, which reflects the voltage selected by the voltage selection portion in the display state of the pixel that corresponds to the flip-flop. Moreover, the flip-flops respectively included in the pixel memory units within the pixel memory portion are connected in series, forming a shift register.

13 Claims, 21 Drawing Sheets

(56) References Cited

U.S. PATENT DOCUMENTS

| | | | | |
|---|---|---|---|---|
| 2004/0041777 | A1 | 3/2004 | Toyozawa et al. | |
| 2005/0001803 | A1* | 1/2005 | Morita et al. | 345/89 |
| 2007/0176875 | A1 | 8/2007 | Kageyama et al. | |
| 2007/0222737 | A1* | 9/2007 | Kimura | 345/100 |
| 2007/0296670 | A1* | 12/2007 | Morita et al. | 345/89 |
| 2008/0094343 | A1* | 4/2008 | Osame et al. | 345/99 |
| 2008/0225030 | A1* | 9/2008 | Worley et al. | 345/208 |
| 2008/0238850 | A1* | 10/2008 | Watanabe | 345/90 |
| 2010/0207848 | A1* | 8/2010 | Cok | 345/76 |
| 2012/0206499 | A1* | 8/2012 | Cok | G09G 3/3208 345/690 |

FOREIGN PATENT DOCUMENTS

| | | | |
|---|---|---|---|
| JP | 2003-140627 | A | 5/2003 |
| JP | 2004-334105 | A | 11/2004 |
| JP | 2005-189274 | A | 7/2005 |
| JP | 2007-199441 | A | 8/2007 |
| JP | 2007-240969 | A | 9/2007 |
| JP | 2007-286237 | A | 11/2007 |
| JP | 2007-328358 | A | 12/2007 |
| JP | 2008-241832 | A | 10/2008 |
| JP | 2009-229850 | A | 10/2009 |

OTHER PUBLICATIONS

Official Communication issued in corresponding European Patent Application No. 11789530.0, mailed on Oct. 16, 2013.

"Sezione XIV Sistemi Digitali", Manuale di Elettronica e Telecomunicazioni, Dec. 31, 2004, 3 pages.

* cited by examiner

DISPLAY DEVICE

TECHNICAL FIELD

The present invention relates to display devices, particularly to a display device provided with a memory function corresponding to each pixel.

BACKGROUND ART

In recent years, some liquid crystal display devices are equipped with a memory function corresponding to each pixel in order to reduce power consumption. Such a device is called, for example, a "memory liquid crystal display" or simply a "memory liquid crystal". In general, the memory liquid crystal display is capable of holding one-bit data for each pixel, and performs image display using data held in memory when displaying the same image or an image that barely changes for a long period of time. In the memory liquid crystal display, when once data is written in the memory, the contents of the data written in the memory are held until the next update. Accordingly, little power is consumed during periods other than before and after a change in the contents of an image. As a result, power consumption is reduced compared to liquid crystal display devices without the memory function.

FIG. 23 is a block diagram illustrating a schematic configuration of a conventional memory liquid crystal display. This memory liquid crystal display is configured by a pixel memory portion 90, a gate driver 92 and a source driver 93 which are for driving the pixel memory portion 90, and a terminal portion 91 for externally receiving various signals and the like. The pixel memory portion 90, the terminal portion 91, the gate driver 92, and the source driver 93 are formed on a panel substrate 900. The pixel memory portion 90 is capable of holding one-bit data for each pixel, as described above. In such a configuration, by the operation of the gate driver 92 and the source driver 93, data corresponding to a display image is stored in memory corresponding to each pixel within the pixel memory portion 90. Then, the image is displayed on the basis of the data stored in the memory.

Note that in relevance to the present invention, Japanese Laid-Open Patent Publication No. 2007-286237 discloses an invention of a display device including pixel memory circuits configured as shown in FIG. 24. In this display device, one pixel memory circuit is provided for each pixel unit consisting of three, i.e., R, G, and B, subpixels, rather than for each of the R, G, and B subpixels. This inhibits an increase in circuit area and realizes low power consumption owing to drive using memory.

PRIOR ART DOCUMENT

Patent Document

Patent Document 1: Japanese Laid-Open Patent Publication No. 2007-286237

SUMMARY OF THE INVENTION

Problems to be Solved by the Invention

The conventional memory liquid crystal display includes the gate driver and the source driver, as with typical liquid crystal display devices without a memory function. The gate driver 92 and the source driver 93 are formed in areas around the pixel memory portion 90, as shown in FIG. 23. Accordingly, when reducing the size of the device, the proportion of the size of a display area (corresponding to an area where the pixel memory portion 90 is formed) in the entire panel is relatively small, resulting in poor product design.

Therefore, an objective of the present invention is to provide a display device capable of reducing a circuit area on a panel substrate and realizing low power consumption by drive using memory.

Means for Solving the Problems

A first aspect of the present invention is directed to a display device, comprising:

a shift register including m flip-flops being provided so as to respectively correspond to m pixels where m is a positive integer, the flip-flops being connected in series so as to sequentially transfer input data in accordance with clock signals;

voltage selection portions provided so as to correspond to their respective flip-flops, each of the voltage selection portions selecting a first voltage or a second voltage in accordance with a logic value of an output signal from each of the flip-flops; and display element portions provided so as to correspond to their respective flip-flops, each of the display element portions reflecting the voltage selected by the voltage selection portion in the display state of the pixel that corresponds to each of the flip-flops.

According to a second aspect of the present invention, in the first aspect of the present invention, each of the flip-flops includes:

a first latch portion for taking in an input signal and holding it as transfer data; and a second latch portion for taking in the transfer data and holding it as output data and outputting the output signal on the basis of the output data.

According to a third aspect of the present invention, in the second aspect of the present invention, the first latch portion includes:

- a first clocked inverter having an input terminal to which the input signal is provided, and operating in accordance with the clock signals;
- a first inverter connected at an input terminal to an output terminal of the first clocked inverter; and
- a second clocked inverter connected at an input terminal to an output terminal of the first inverter and connected at an output terminal to the input terminal of the first inverter, and operating in accordance with the clock signals, and the second latch portion includes:

- a third clocked inverter connected at an input terminal to the output terminal of the first inverter and operating in accordance with the clock signals;
- a second inverter connected at an input terminal to an output terminal of the third clocked inverter; and
- a fourth clocked inverter connected at an input terminal to an output terminal of the second inverter and connected at an output terminal to the input terminal of the second inverter, and operating in accordance with the clock signals, and the output signal is outputted from the output terminal of the second inverter.

According to a fourth aspect of the present invention, in the second aspect of the present invention, the first latch portion includes:

- a first clocked inverter having an input terminal to which the input signal is provided, and operating in accordance with the clock signals; and
- a capacitance having one end to which an output terminal of the first clocked inverter is connected and having the other end to which a predetermined potential is provided, the second latch portion includes:

a third clocked inverter connected at an input terminal to the output terminal of the first inverter and operating in accordance with the clock signals;

a second inverter connected at an input terminal to an output terminal of the third clocked inverter; and a fourth clocked inverter connected at an input terminal to an output terminal of the second inverter and connected at an output terminal to the input terminal of the second inverter, and operating in accordance with the clock signals, and the output signal is outputted from the output terminal of the second inverter.

According to a fifth aspect of the present invention, in the second aspect of the present invention, m pieces of data corresponding to the m flip-flops are provided to the shift register as the input data, and the clock signals stop their action after the m pieces of data are held as the transfer data in the first latch portions included in the corresponding flip-flops.

According to a sixth aspect of the present invention, in the second aspect of the present invention, the display device further comprises white display function portions provided so as to correspond to their respective flip-flops, wherein, m pieces of data corresponding to the m flip-flops are provided to the shift register as the input data, and the white display function portions maintain the display states of the pixels at white display until the m pieces of data are held as the transfer data in the first latch portions included in the corresponding flip-flops.

According to a seventh aspect of the present invention, in the sixth aspect of the present invention, each of the white display function portions includes:

a first switch for controlling whether to provide the output signal to the display element portion, on the basis of an instruction signal indicating whether to maintain the display state of the pixel at white display; and a second switch for controlling whether to provide a white display voltage to the display element portion, on the basis of the instruction signal, and the output signal or the white display voltage is provided to the display element portion in accordance with a logic value of the instruction signal.

According to an eighth aspect of the present invention, in the first aspect of the present invention, the display device further comprises a voltage control portion for controlling a magnitude of an input voltage on the basis of a control signal, wherein, in each of the display element portions, the display state of the pixel changes on the basis of a difference between the voltage selected by the voltage selection portion and a predetermined third voltage, and the voltage control portion receives the first voltage and the second voltage as the input voltages, and equalizes the magnitudes of both the first voltage and the second voltage with the magnitude of the third voltage when the control signal is at a prescribed level.

According to a ninth aspect of the present invention, in the first aspect of the present invention, the m pixels and the m flip-flops are arranged in matrix of i rows×j columns, in each row, neighboring flip-flops are connected to each other, and in any three consecutive rows, the flip-flop in the first row, j'th column is connected to the flip-flop in the second row, j'th column, and the flip-flop in the second row, first column is connected to the flip-flop in the third row, first column, or the flip-flop in the first row, first column is connected to the flip-flop in the second row, first column, and the flip-flop in the second row, j'th column is connected to the flip-flop in the third row, j'th column.

According to a tenth aspect of the present invention, in the first aspect of the present invention, the m pixels and the m flip-flops are arranged in matrix of i rows×j columns, in each row, neighboring flip-flops are connected to each other, and in any two consecutive rows, the flip-flop in the first row, j'th column is connected to the flip-flop in the second row, first column.

According to an eleventh aspect of the present invention, in the first aspect of the present invention, each of the pixels is composed of n subpixels where n is an integer of 2 or more, the flip-flops are provided so as to respectively correspond to the n subpixels included in the pixels, n shift registers are provided such that, for each pixel, the n flip-flops corresponding to that pixel constitute a different shift register from one another, and to the n shift registers, different data are provided from one another as the input data.

According to a twelfth aspect of the present invention, in the eleventh aspect of the present invention, n pixel electrodes forming the n subpixels included in each pixel are different in area.

According to a thirteenth aspect of the present invention, in the eleventh aspect of the present invention, each of the pixels is composed of three subpixels respectively corresponding to red, green, and blue, and red data, green data, and blue data are provided as the input data respectively to three shift registers respectively corresponding to the three subpixels.

Effects of the Invention

According to the first aspect of the present invention, the display device includes a shift register which is configured by flip-flops being provided so as to respectively correspond to pixels and being connected in series, voltage selection portions for selecting either of two voltages in accordance with output signals of the flip-flops, and display element portions for reflecting the voltages selected by the voltage selection portions in display states of the pixels corresponding to the flip-flops. Each flip-flop is capable of holding one-bit data. Therefore, in each flip-flop, while transferring input data to the flip-flop in the next stage, it is possible to set the display state of its corresponding pixel to a display state based on the input data by providing the input data to the voltage selection portion. Specifically, data corresponding to a display image can be provided to all of the flip-flops (i.e., memories corresponding to the pixels) constituting the shift register by providing display image data to the shift register without providing driver circuits (a scanning signal line driver circuit and a video signal line driver circuit) as included in typical conventional display devices. Here, the contents of data latched in the flip-flops are maintained until the next update, so that the same image can be continuously displayed without unnecessary power consumption. Thus, it is possible to realize a display device capable of reducing a circuit area compared to conventional devices and realizing low power consumption by drive using memory.

According to the second aspect of the present invention, it is possible to realize a display device capable of reducing a circuit area compared to conventional devices and realizing low power consumption by drive using memory, as in the first aspect of the invention.

According to the third aspect of the present invention, it is possible to realize a display device capable of reducing a circuit area compared to conventional devices and realizing low power consumption by drive using memory, as in the first aspect of the invention.

According to the fourth aspect of the present invention, the first latch portion of each flip-flop is configured by one clocked inverter and one capacitance. Thus, since the flip-flops can be realized by a relatively small number of transistors, a circuit area on a panel substrate can be effectively reduced.

According to the fifth aspect of the present invention, the clock signals stop their action after data corresponding to a display image is held in all of the flip-flops constituting the shift register. Thus, while the same image is continuously displayed, there is no power consumption due to the clock signals, effectively reducing power consumption.

According to the sixth aspect of the present invention, the display states of all pixels are set at white display until data based on a display image is held in all of the flip-flops constituting the shift register. As a result, when an image is displayed or the contents of the image change, the image to be displayed is presented after full-screen white display is performed. Thus, noise can be barely perceived.

According to the seventh aspect of the present invention, by providing a circuit with a relatively simplified configuration, occurrence of noise when an image is displayed or the contents of the image change is suppressed.

According to the eighth aspect of the present invention, until data based on a display image is held in all of the flip-flops constituting the shift register, the display states of all pixels can be set at white display (in the case of the normally white mode) or at black display (in the case of the normally black mode) by setting the control signal at a prescribed level. As a result, when an image is displayed or the contents of the image change, the image to be displayed is presented after full-screen white display or full-screen black display is performed. Thus, noise can be barely perceived.

According to the ninth aspect of the present invention, since the area of wiring for connecting neighboring flip-flops decreases, a circuit area for drive using memory is effectively reduced.

According to the tenth aspect of the present invention, in a display device with pixels and flip-flops being arranged in matrix, data provided to a shift register is transferred in the same direction in all rows. Thus, display image data to be held in the flip-flops can be readily generated.

According to the eleventh aspect of the present invention, one pixel is configured by a plurality of subpixels, and the display state can be set to white display or black display for each subpixel. Thus, it is possible to provide halftone display on a display device capable of realizing low power consumption by drive using memory.

According to the twelfth aspect of the present invention, halftone brightness can be controlled by adjusting the area ratio of n pixel electrodes. Moreover, when compared to the case where n pixel electrodes are equal in area, the number of tones that can be displayed increases.

According to the thirteenth aspect of the present invention, color display can be achieved by providing sets of color filters or color display functions so as to correspond to their respective sets of three subpixels. Thus, it is possible to realize a color display device capable of realizing low power consumption by drive using memory.

MODE FOR CARRYING OUT THE INVENTION

Hereinafter, an embodiment of the present invention will be described with reference to the accompanying drawings.

<1. Schematic Configuration of the Liquid Crystal Display Device>

Figure 2:
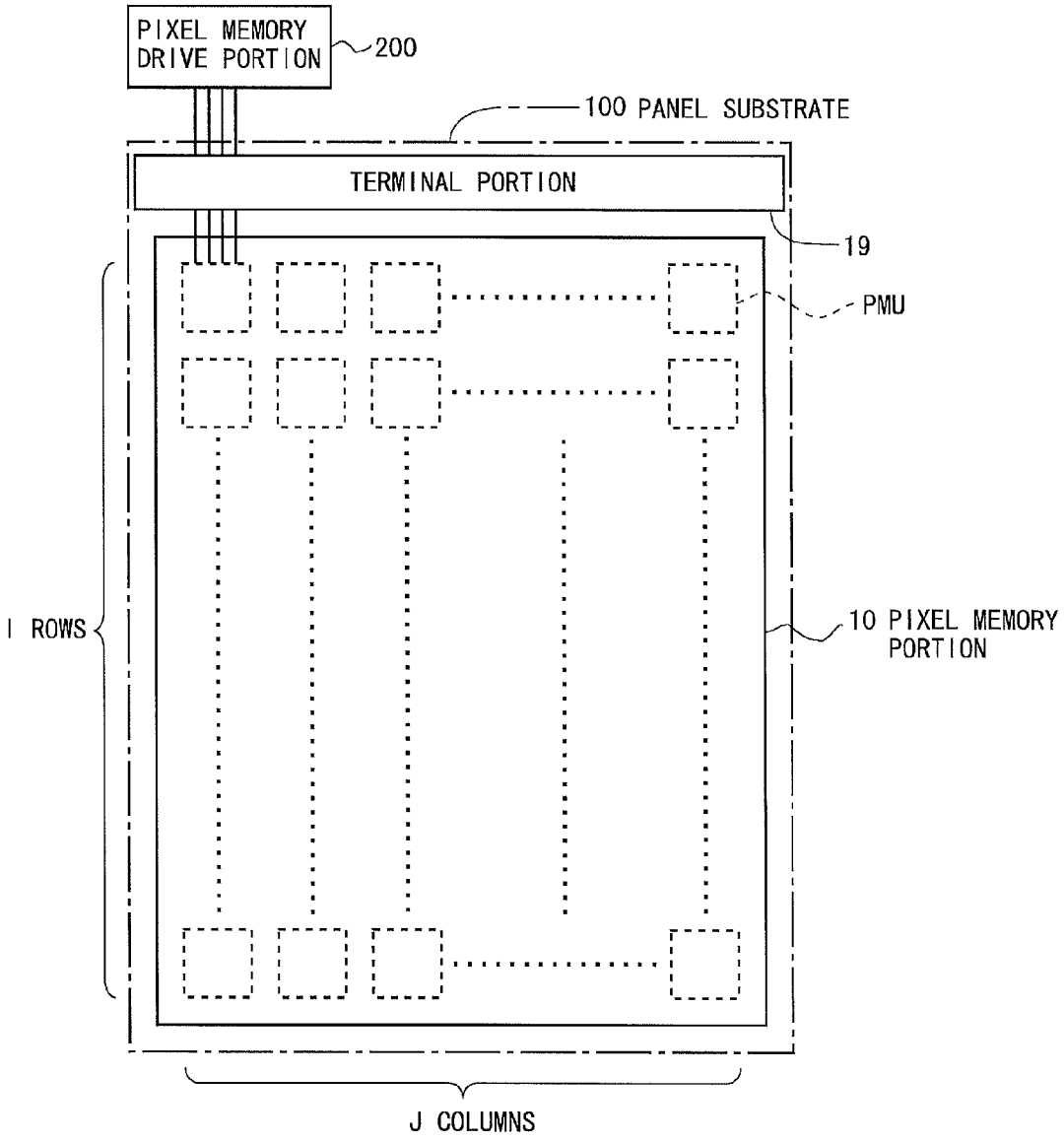
FIG. 2 is a block diagram illustrating a schematic configuration of the liquid crystal display device in the embodiment.

FIG. 2 is a block diagram illustrating a schematic configuration of a liquid crystal display device according to an embodiment of the present invention. As shown in FIG. 2, the liquid crystal display device includes a panel substrate 100 on which a pixel memory portion 10 and a terminal portion 19 are formed, and a pixel memory drive portion 200 provided (e.g., on a flexible circuit substrate) outside the panel substrate 100. The pixel memory portion 10 includes pixel memory units PMU arranged in i rows×j columns. Note that one pixel memory unit PMU is a component equivalent to one pixel. The pixel memory units PMU are capable of holding one-bit data, and an image is displayed in accordance with values of data held in the pixel memory units PMU. The terminal portion 19 is provided with terminals for connecting signal wiring extending from the pixel memory drive portion 200 to the panel substrate 100 and signal wiring arranged in the panel substrate 100. The pixel memory drive portion 200 supplies the pixel memory portion 10 with, for example, signals for operating the pixel memory units PMU. Note that it is assumed below that the pixel memory portion 10 includes nine (three rows×three columns) pixel memory units PMU.

Figure 3:
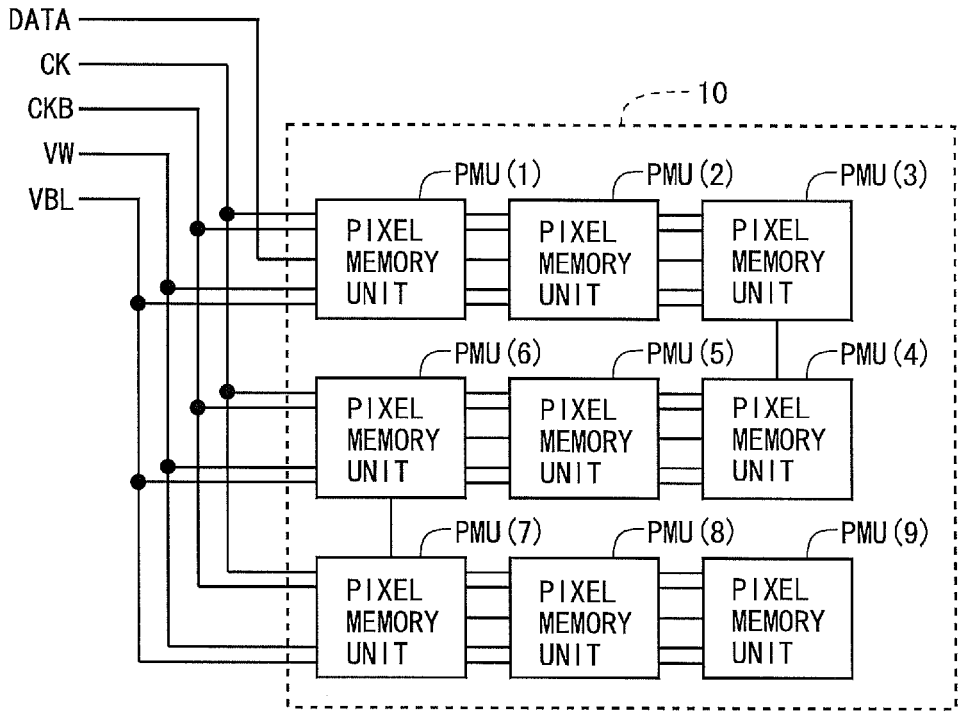
FIG. 3 is a block diagram illustrating the configuration of a pixel memory portion in the embodiment.

FIG. 3 is a block diagram illustrating the configuration of the pixel memory portion 10. The pixel memory portion 10 includes nine pixel memory units PMU(1) to PMU(9), as shown in FIG. 3. All of pixel memory units PMU(1) to PMU(9) are commonly provided with two-phase clock signals CK and CKB, white display voltage $V_W$ for setting the display state of the pixels to white display, and black display voltage $V_{BL}$ for setting the display state of the pixels to black display. Moreover, pixel memory unit PMU(1) is provided with display data DATA for specifying the display state of the pixel.

Figure 4:
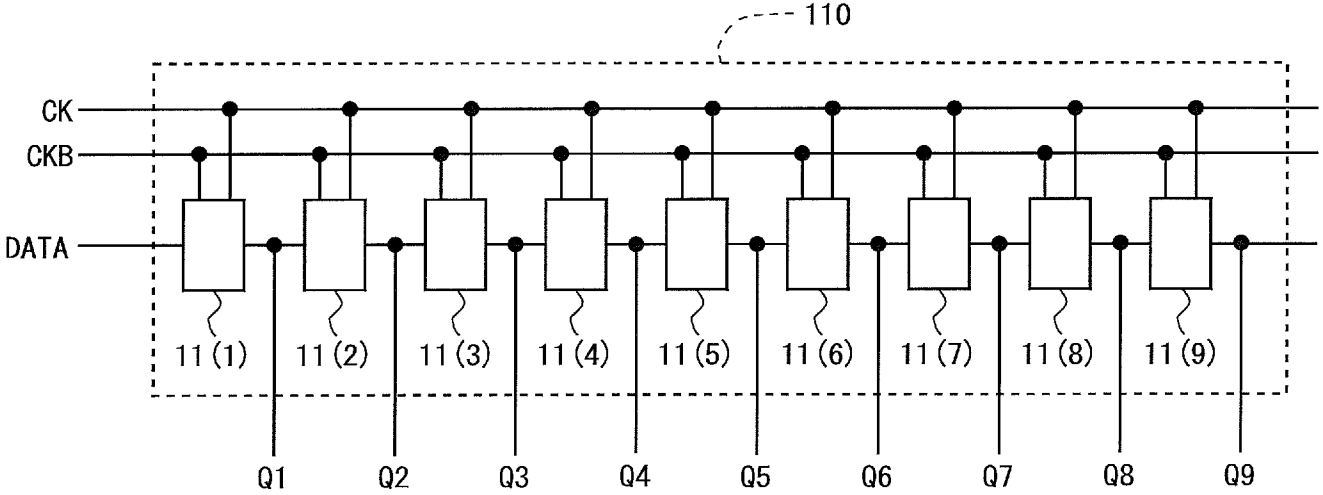
FIG. 4 is a diagram describing a shift register which is configured by flip-flops in the embodiment.

Incidentally, each pixel memory unit PMU includes a flip-flop capable of holding one-bit data. In addition, flip-flops 11(1) to 11(9) respectively included in pixel memory units PMU(1) to PMU(9) are connected in series, as shown in FIG. 4, forming a shift register 110. Accordingly, the display data DATA provided to pixel memory unit PMU(1) is transferred sequentially to pixel memory units PMU(2) to PMU(9) on the basis of the clock signals CK and CKB.

Furthermore, in the present embodiment, the flip-flop within pixel memory unit PMU(3) in the first row, third column is connected to the flip-flop within pixel memory unit PMU(4) in the second row, third column, and the flip-flop within pixel memory unit PMU(6) in the second row, first column is connected to the flip-flop within pixel memory unit PMU(7) in the third row, first column, as shown in FIG. 3.

<2. Configuration and General Operation of the Pixel Memory Unit>

Figure 1:
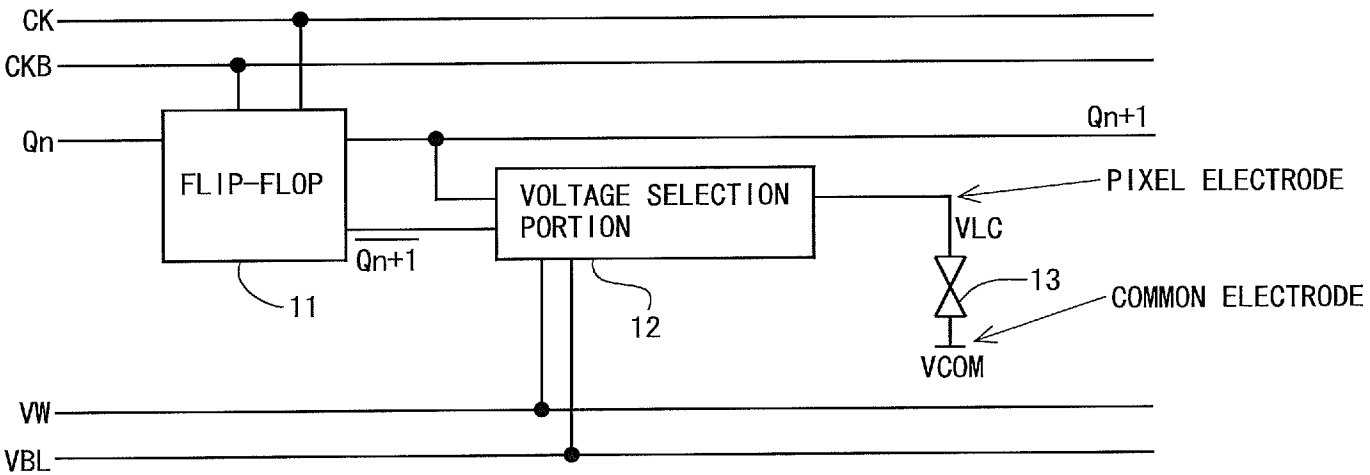
FIG. 1 is a block diagram illustrating the configuration of a pixel memory unit in a liquid crystal display device according to an embodiment of the present invention.

FIG. 1 is a block diagram illustrating the configuration of the pixel memory unit PMU. The pixel memory unit PMU includes a flip-flop 11, a voltage selection portion 12, and a liquid crystal capacitance 13, as shown in FIG. 1. The flip-flop 11 receives signal Qn (an output signal of the flip-flop 11 in the previous stage) as an input signal, and outputs a "signal Qn+1" and a "logic-inversion signal of signal Qn+1" as output signals on the basis of clock signals CK and CKB. Note that the "logic-inversion signal of signal Qn+1" will be represented below as "signal Qn+1B". The voltage selection portion 12 selects either white display voltage VW or black display voltage VBL on the basis of a signal Qn+1 and a signal Qn+1B, and outputs the selected voltage as pixel electrode voltage VLC. The liquid crystal capacitance 13 is formed by the pixel electrode and the common electrode, and the display state of the pixel changes in accordance with the difference between pixel electrode voltage VLC and common electrode voltage VCOM.

Figure 5:
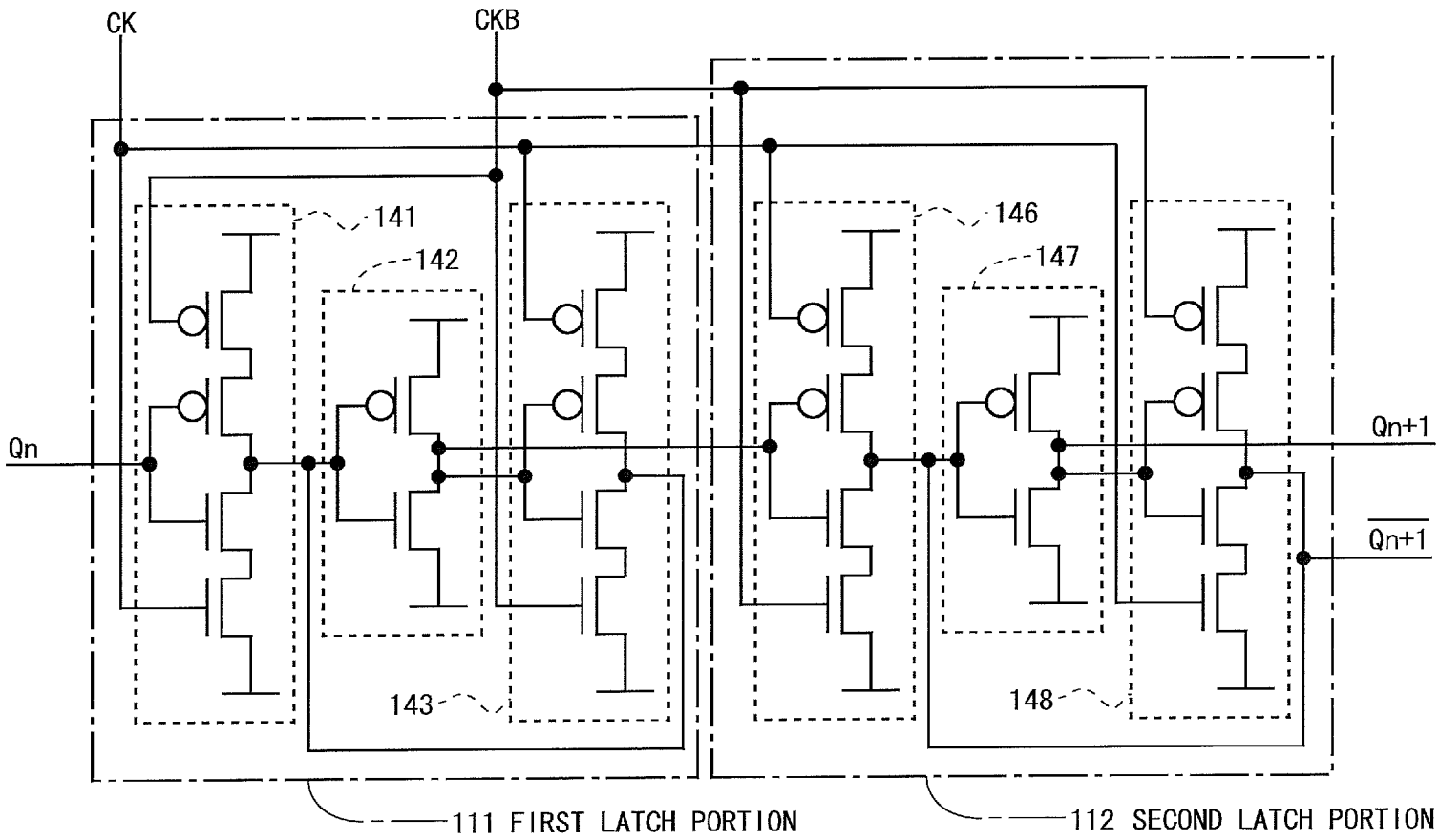
FIG. 5 is a circuit diagram illustrating a specific configuration example of the flip-flop in the embodiment.

FIG. 5 is a circuit diagram illustrating a specific configuration example of the flip-flop 11. The flip-flop 11 is configured by a first latch portion 111 for taking in the signal Qn and holding it as transfer data, and a second latch portion 112 for taking in the transfer data and holding it as output data and outputting a signal Qn+1 and a signal Qn+1B on the basis of the output data.

The first latch portion 111 is configured by a clocked inverter (referred to below as a "first clocked inverter") 141 in which signal Qn is provided to an input terminal, an inverter (referred to below as a "first inverter") 142 connected at an input terminal to an output terminal of the first clocked inverter 141, and a clocked inverter (referred to below as a "second clocked inverter") 143 connected at an input terminal to an output terminal of the first inverter 142 and connected at an output terminal to the input terminal of the first inverter 142. Note that the output terminal of the first inverter 142 is also connected to an input terminal of a third clocked inverter 146 to be described later.

The second latch portion 112 is configured by a clocked inverter (referred to below as the "third clocked inverter") 146 connected at an input terminal to the output terminal of the first inverter 142, an inverter (referred to below as a "second inverter") 147 connected at an input terminal to an output terminal of the third clocked inverter 146, and a clocked inverter (referred to below as a "fourth clocked inverter") 148 connected at an input terminal to an output terminal of the second inverter 147 and connected at an output terminal to the input terminal of the second inverter 147. Note that signal Qn+1 is outputted from the output terminal of the second inverter 147, and signal Qn+1B is outputted from the output terminal of the fourth clocked inverter 148.

Note that the first clocked inverter 141 and the fourth clocked inverter 148 function as inverters when the clock signal CK is at high level and the clock signal CKB is at low level, and their input and output terminals are electrically disconnected when the clock signal CK is at low level and the clock signal CKB is at high level. Moreover, the second clocked inverter 143 and the third clocked inverter 146 have their input and output terminals electrically disconnected when the clock signal CK is at high level and the clock signal CKB is at low level, and they function as inverters when the clock signal CK is at low level and the clock signal CKB is at high level.

With the configuration as described above, in the flip-flop 11, the value of signal Qn, which is provided during a period in which the clock signal CK is at high level and the clock signal CKB is at low level, is held in the first latch portion 111 as transfer data. Thereafter, at the timing when the clock signal CK changes from high level to low level and the clock signal CKB changes from low level to high level, the value of signal Qn being held in the first latch portion 111 as transfer data appears as the waveform of signal Qn+1. In addition, the transfer data is held in the second latch portion 112, so that the waveform of signal Qn+1 is maintained until the next time the clock signal CK changes from high level to low level and the clock signal CKB changes from low level to high level.

Figure 6:
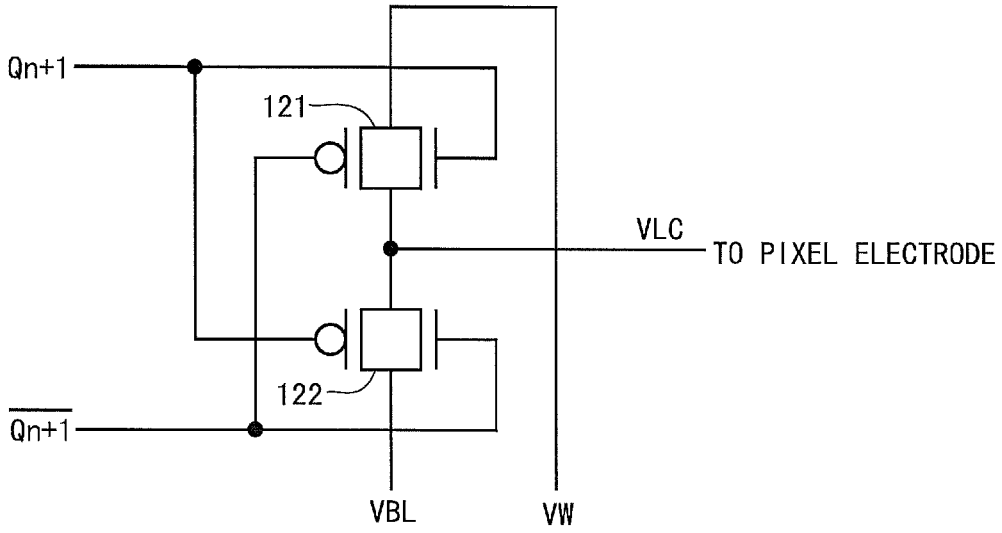
FIG. 6 is a circuit diagram illustrating a specific configuration example of a voltage selection portion in the embodiment.

FIG. 6 is a circuit diagram illustrating a specific configuration example of the voltage selection portion 12. The voltage selection portion 12 includes CMOS switches 121 and 122, each consisting of a P-type TFT and an N-type TFT. The CMOS switch 121 has an input terminal to which white display voltage VW is provided and an output terminal connected to the pixel electrode. Signal Qn+1 is provided to a gate terminal of the N-type TFT in the CMOS switch 121 and signal Qn+1B is provided to a gate terminal of the P-type TFT in the CMOS switch 121. The CMOS switch 122 has an input terminal to which black display voltage VBL is provided and an output terminal connected to the pixel electrode. Signal Qn+1B is provided to a gate terminal of the N-type TFT in the CMOS switch 122 and signal Qn+1 is provided to a gate terminal of the P-type TFT in the CMOS switch 122. With the configuration as described above, when signal Qn+1 is at high level and signal Qn+1B is at low level, the CMOS switch 121 is brought into ON state and the CMOS switch 122 is brought into OFF state, so that white display voltage VW is provided to the pixel electrode. On the other hand, when signal Qn+1 is at low level and signal Qn+1B is at high level, the CMOS switch 121 is brought into OFF state and the CMOS switch 122 is brought into ON state, so that black display voltage VBL is provided to the pixel electrode.

<3. Drive Method>

Figure 7:
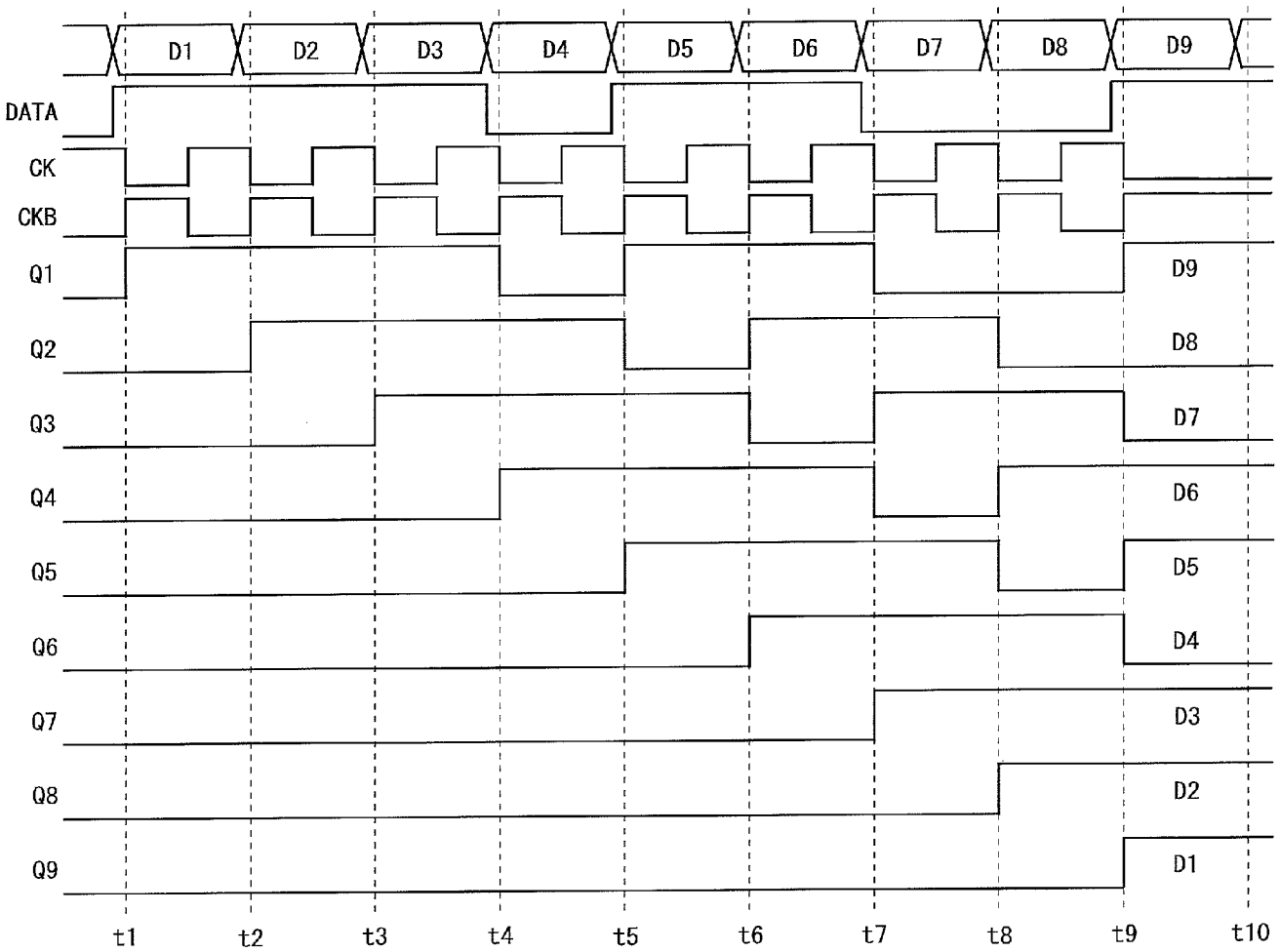
FIG. 7 is a signal waveform chart describing a method for driving the pixel memory portion in the embodiment.

Next, referring to FIGS. 4 and 7, a method for driving the memory display portion 10 in the present embodiment will be described. Note that characters assigned to the first waveform in a signal waveform chart shown in FIG. 7 are intended in the present description to distinguish one-bit data inputted at each time to flip-flop 11(1) by display data DATA. For example, in FIG. 7, "data D5" is inputted to flip-flop 11(1) by way of display data DATA during a period from time t5 to time t6.

At time t1, data D1 is inputted to flip-flop 11(1) as display data DATA. At time t1, the clock signal CK changes from high level to low level, and the clock signal CKB changes from low level to high level. Accordingly, output signal Q1 of flip-flop 11(1) is set to high level on the basis of the value of data D1. Note that output signal Q1 is provided to the voltage selection portion 12 (see FIG. 6) and is also provided to flip-flop 11(2).

At time t2, data D2 is inputted to flip-flop 11(1) as display data DATA. Since output signal Q1 of flip-flop 11(1) is provided to flip-flop 11(2), data $D_1$ is inputted to flip-flop 11(2) at this time. Moreover, at time t2, in the same manner at time t1, the clock signal CK changes from high level to low level, and the clock signal CKB changes from low level to high level. Accordingly, output signal Q1 of flip-flop 11(1) is maintained at high level on the basis of the value of data D2, and output signal Q2 of flip-flop 11(2) is set to high level on the basis of the value of data D1.

In this manner, also at and after time t3, data inputted to flip-flop 11(1) as display data DATA are sequentially transferred to flip-flops 11(2) to 11(9). As a result, when input of data D1 to D9 to flip-flop 11(1) as display data DATA ends, output signal Q1 of flip-flop 11(1) is set to a level based on data D9, output signal Q2 of flip-flop 11(2) is set to a level based on data D8, . . . , and output signal Q9 of flip-flop 11(9) is set to a level based on data D1. Note that after all of data D1 to D9 as display data DATA are held in the first latch portions 111 within their corresponding flip-flops, the clock signals CK and CKB stop their action.

Figure 8:
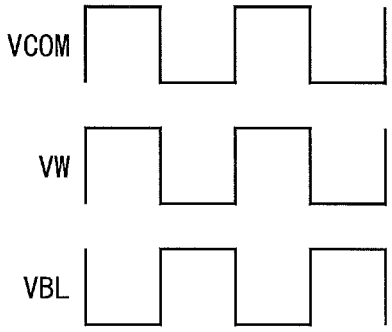
FIG. 8 is a signal waveform chart describing a method for driving the pixel memory portion in the embodiment.

From flip-flops 11(1) to 11(9), the aforementioned output signals Q1 to Q9 and logic-inversion signals thereof are outputted. These signals are provided to the voltage selection portions 12 that correspond to their respective flip-flops 11. Here, referring to FIG. 8, the waveforms of white display voltage VW and black display voltage VBL provided to the voltage selection portions 12 will be described. Common electrode voltage VCOM alternates between high level and low level every predetermined period of time. White display voltage VW and common electrode voltage VCOM are in the same phase. Black display voltage VBL and common electrode voltage VCOM are out of phase by 180 degrees. High-level potentials of white display voltage VW and black display voltage VBL are approximately equal to a high-level potential of common electrode voltage VCOM. Low-level potentials of white display voltage VW and black display voltage VBL are approximately equal to a low-level potential of common electrode voltage VCOM. Therefore, the difference in potential between white display voltage VW and common electrode voltage VCOM is maintained at approximately 0. On the other hand, the difference in potential between black display voltage VBL and common electrode voltage VCOM is maintained at a magnitude approximately equivalent to the amplitude of black display voltage VBL.

Figure 9:
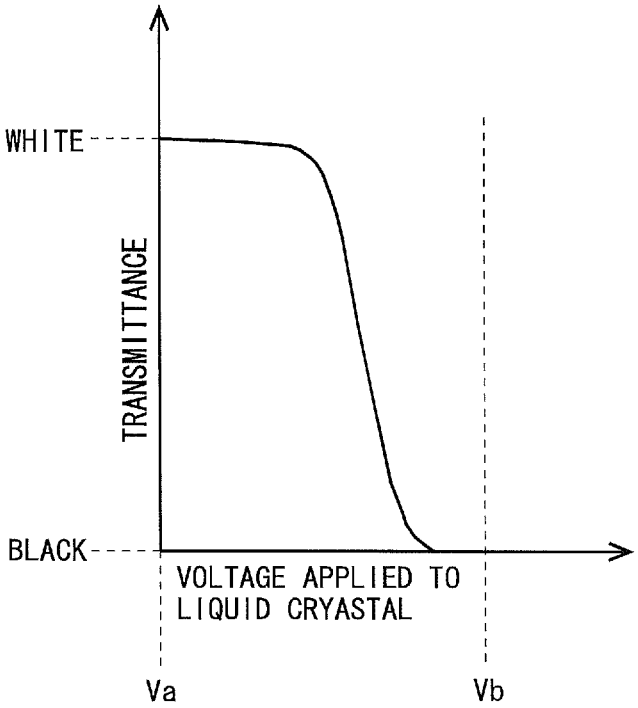
FIG. 9 is a graph illustrating the relationship between voltage applied to liquid crystal and transmittance in the embodiment.

FIG. 9 is a graph illustrating the relationship between voltage applied to liquid crystal and transmittance. Note that the relationship shown in FIG. 9 is about a liquid crystal display device employing a normally white mode. It can be appreciated from FIG. 9 that as the voltage applied to liquid crystal decreases, the transmittance increases, and as the voltage applied to liquid crystal increases, the transmittance decreases. In FIG. 9, voltage Va is equivalent to the difference between the potential of white display voltage VW and the potential of common electrode voltage VCOM, and voltage Vb is equivalent to the difference between the potential of black display voltage VBL and the potential of common electrode voltage VCOM. Moreover, as mentioned above, when signal Qn+1 is at high level and signal Qn+1B is at low level, white display voltage VW is provided to the pixel electrode, and when signal Qn+1 is at low level and signal Qn+1B is at high level, black display voltage VBL is provided to the pixel electrode (see FIG. 6). For any pixel memory unit PMU in which white display voltage VW is provided to the pixel electrode, the display state of the pixel is set to white display. For any pixel memory unit PMU in which black display voltage VBL is provided to the pixel electrode, the display state of the pixel is set to black display.

Figure 10:
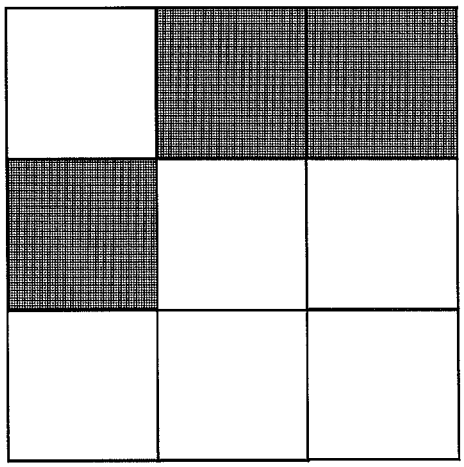
FIG. 10 is a diagram illustrating an exemplary display image in the embodiment.

In this manner, when display data DATA with the waveform as shown in FIG. 7 is provided to the pixel memory portion 10 from the pixel memory drive portion 200, output signals Q1, Q4, Q5, Q7, Q8, and Q9 of flip-flops 11(1), 11(4), 11(5), 11(7), 11(8), and 11(9) are set to high level, and output signals Q2, Q3, and Q6 of flip-flops 11(2), 11(3), and 11(6) are set to low level. As a result, the display states of the pixels corresponding to pixel memory units PMU(1), PMU(4), PMU(5), PMU(7), PMU(8), and PMU(9) are set to white display, and the display states of the pixels corresponding to pixel memory units PMU(2), PMU(3), and PMU(6) are set to black display, as shown in FIG. 10.

Figure 11:
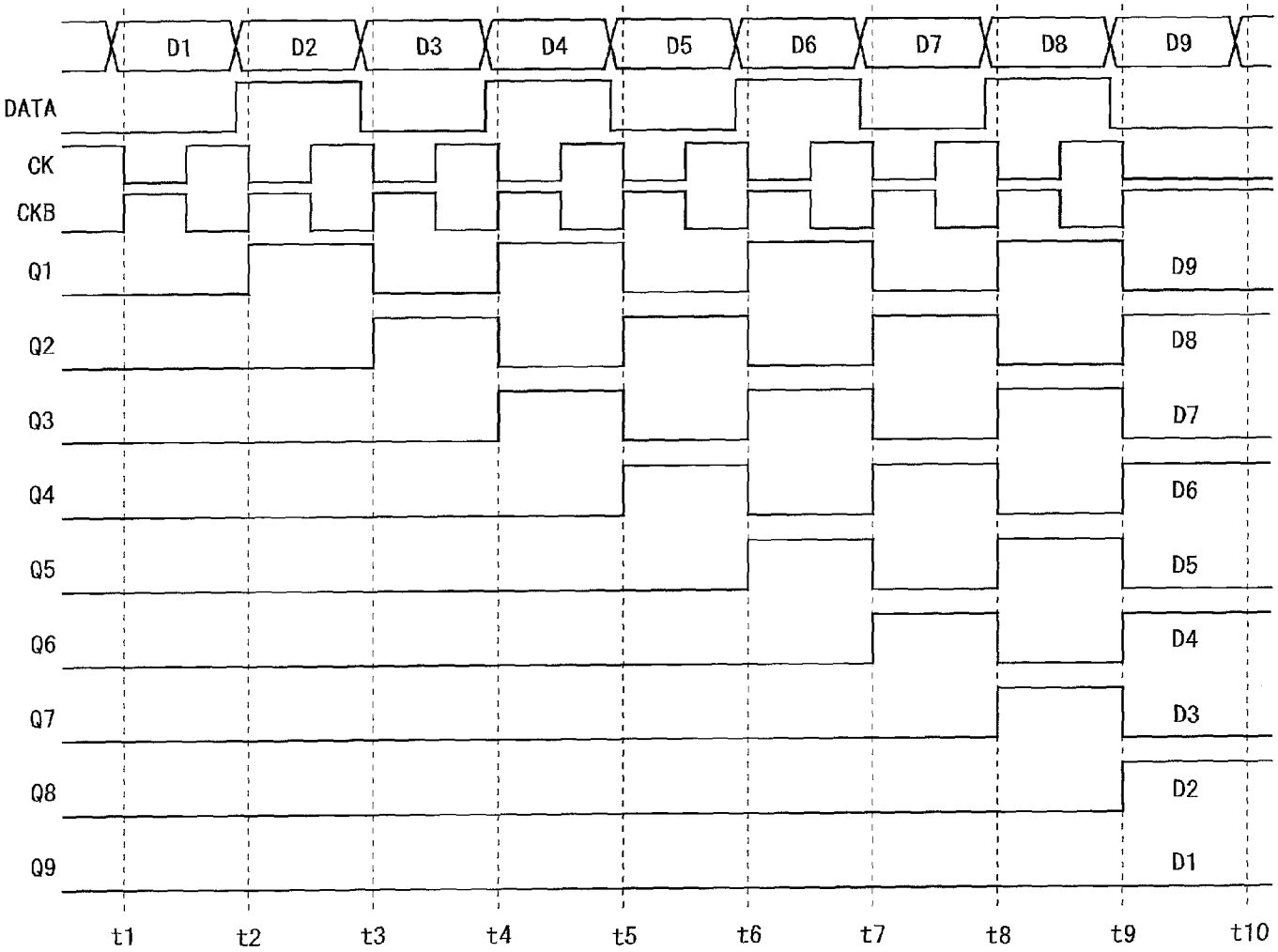
FIG. 11 is a signal waveform chart describing a method for driving the pixel memory portion in the embodiment.
Figure 12:
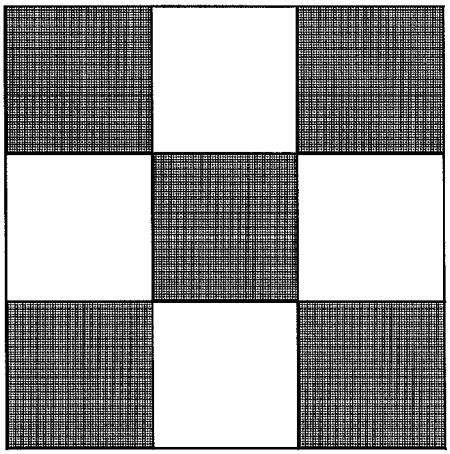
FIG. 12 is a diagram illustrating an exemplary display image in the embodiment.

Furthermore, when display data DATA with the waveform as shown in FIG. 11 is provided to the pixel memory portion 10 from the pixel memory drive portion 200, output signals Q2, Q4, Q6, and Q8 of flip-flops 11(2), 11(4), 11(6), and 11(8) are set to high level, and output signals Q1, Q3, Q5, Q7 and Q9 of flip-flops 11(1), 11(3), 11(5), 11(7), and 11(9) are set to low level. As a result, the display states of the pixels corresponding to pixel memory units PMU(2), PMU(4), PMU(6), and PMU(8) are set to white display, and the display states of the pixels corresponding to pixel memory units PMU(1), PMU(3), PMU(5), PMU(7), and PMU(9) are set to black display, as shown in FIG. 12.

<4. Effects>

According to the present embodiment, as corresponding to each pixel memory unit PMU, there are provided a voltage selection portion 12, which selects either white display voltage $V_W$ or black display voltage $V_{BL}$ in accordance with an output signal of the flip-flop 11 in the pixel memory unit PMU, and a liquid crystal capacitance 13, which reflects the voltage selected by the voltage selection portion 12 in the display state of the pixel that corresponds to the flip-flop 11. Moreover, the flip-flops 11 respectively included in the pixel memory units PMU within the pixel memory portion 10 are connected in series, forming the shift register 110. The flip-flops 11 are capable of holding one-bit data, which makes it possible for each flip-flop 11 to transfer input data to the flip-flop 11 in the next stage and to set the display state of the corresponding pixel to a display state based on the input data. Specifically, data corresponding to a display image can be provided to the flip-flops 11 within all of the pixel memory units PMU by providing display data DATA to the shift register 110, without providing a gate driver or a source driver. The contents of data latched in the flip-flops 11 are maintained until the next update, so that the same image can be continuously displayed without unnecessary power consumption. Thus, it is possible to realize a liquid crystal display device capable of reducing a circuit area on a panel substrate compared to conventional devices and realizing low power consumption by drive using memory.

Furthermore, according to the present embodiment, after data corresponding to a display image is held in the flip-flops 11 within all of the pixel memory units PMU, the clock signals CK and CKB stop their action. Thus, while the same image is continuously displayed, there is no power consumption due to the clock signals CK and CKB, effectively reducing power consumption.

<5. Variants>

Hereinafter, variants of the embodiment will be described.

<5.1 First Variant>

Figure 13:
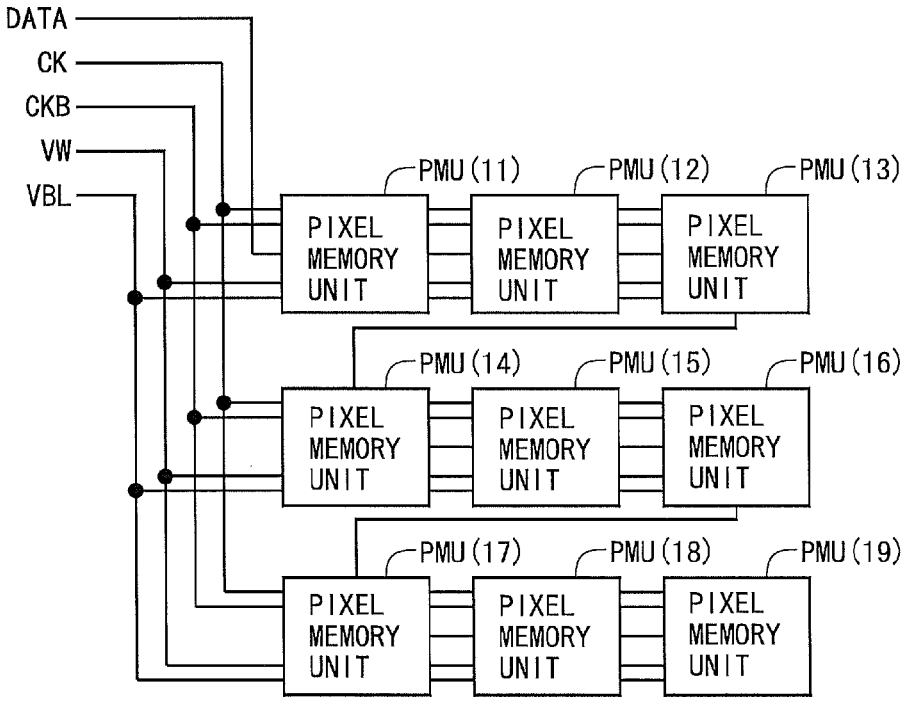
FIG. 13 is a block diagram illustrating the configuration of a pixel memory portion in a first variant of the embodiment.

FIG. 13 is a block diagram illustrating the configuration of a pixel memory portion 10 in a first variant of the embodiment. In the present variant, the flip-flop 11 within pixel memory unit PMU(13) in the first row, third column is connected to the flip-flop 11 within pixel memory unit PMU(14) in the second row, first column, and the flip-flop 11 within pixel memory unit PMU(16) in the second row, third column is connected to the flip-flop 11 within pixel memory unit PMU(17) in the third row, first column. Accordingly, display data DATA is transferred in the same direction in all of the rows. Thus, when compared to the above-described embodiment where display data DATA is transferred in different directions in odd and even rows, display data DATA can be readily generated.

<5.2 Second Variant>

Figure 14:
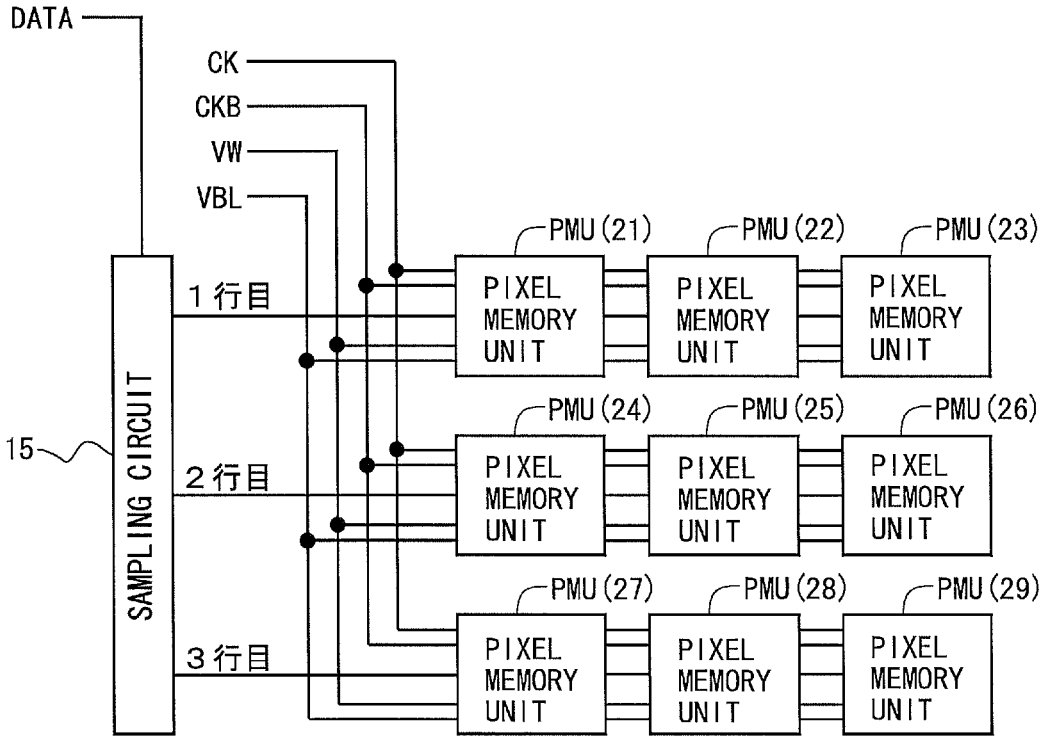
FIG. 14 is a block diagram illustrating the configuration of a pixel memory portion in a second variant of the embodiment.

FIG. 14 is a block diagram illustrating the configuration of a pixel memory portion 10 in a second variant of the embodiment. In the present variant, one shift register is constituted by the flip-flops 11 within all pixel memory units PMU in each row, rather than by the flip-flops 11 within all pixel memory units PMU included in the pixel memory portion 10. Accordingly, in the present variant, the pixel memory portion 10 includes three shift registers. Moreover, in the present variant, a sampling circuit 15 for sampling display data DATA is provided in the pixel memory portion 10. The sampling circuit 15 provides display data DATA to pixel memory unit PMU(21) when data to be held in the flip-flops 11 within pixel memory units PMU(21) to PMU(23) is provided as the display data DATA, the sampling circuit 15 provides display data DATA to pixel memory unit PMU(24) when data to be held in the flip-flops 11 within pixel memory units PMU(24) to PMU(26) is provided as the display data DATA, and the sampling circuit 15 provides display data DATA to pixel memory unit PMU(27) when data to be held in the flip-flops 11 within pixel memory units PMU(27) to PMU(29) is provided as the display data DATA. In this manner, also in the present variant, data corresponding to a display image can be stored to the flip-flops 11 within all of the pixel memory units PMU included in the pixel memory portion 10.

<5.3 Third Variant>

Figure 15:
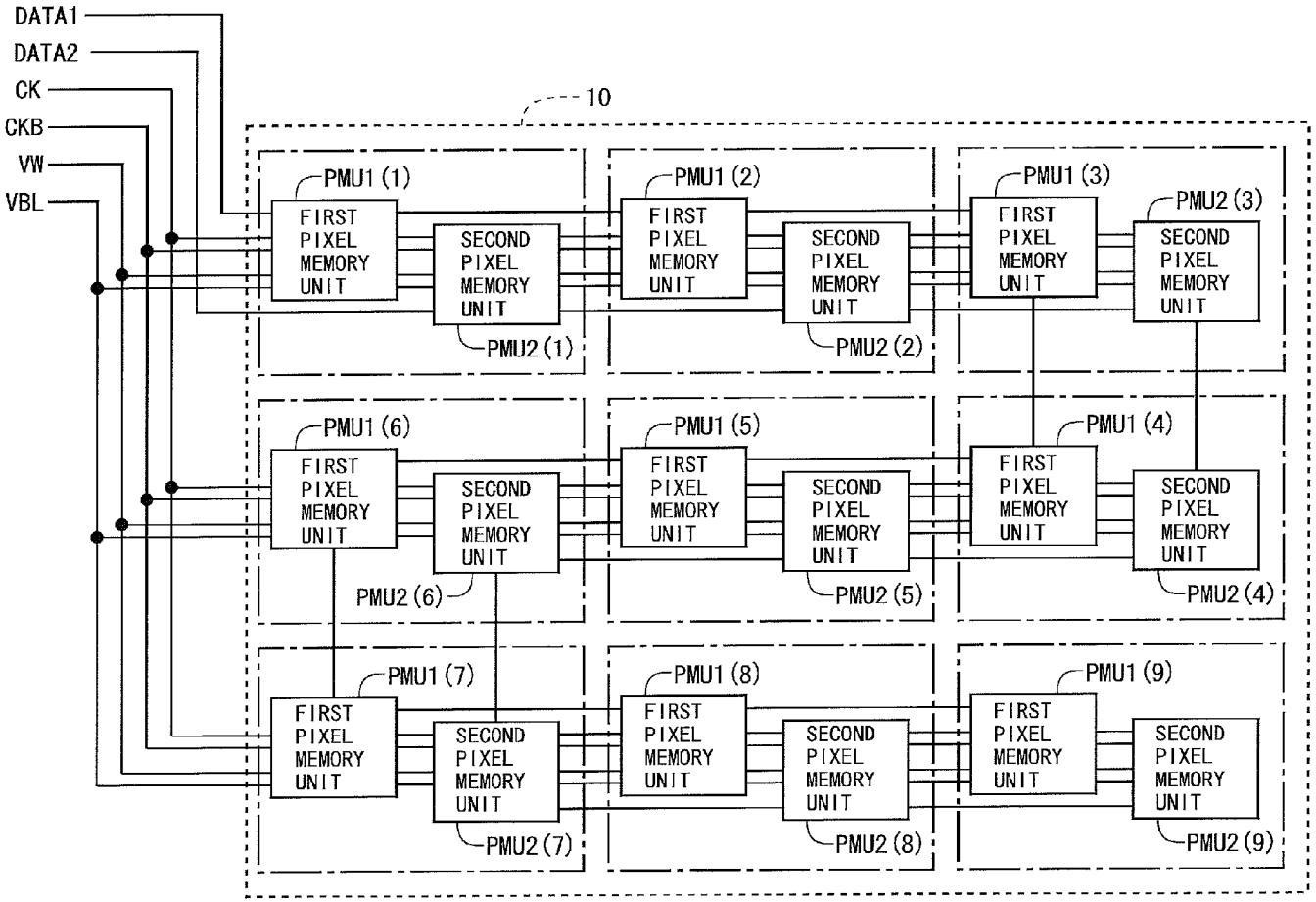
FIG. 15 is a block diagram illustrating the configuration of a pixel memory portion in a third variant of the embodiment.

FIG. 15 is a block diagram illustrating the configuration of a pixel memory portion 10 in a third variant of the embodiment. In the present variant, one pixel is composed of two subpixels. Herein, a pixel memory unit provided so as to correspond to one subpixel is referred to as a "first pixel memory unit", and a pixel memory unit provided so as to correspond to the other subpixel is referred to as a "second pixel memory unit".

The pixel memory portion 10 includes nine first pixel memory units PMU1(1) to PMU1(9) and nine second pixel memory units PMU2(1) to PMU2(9), as shown in FIG. 15. Clock signals CK and CKB, white display voltage VW, and black display voltage VBL are commonly provided to first pixel memory units PMU1(1) to PMU1(9) and second pixel memory units PMU2(1) to PMU2(9). As for display data, different data is provided to first pixel memory unit PMU1(1) and second pixel memory unit PMU2(1). In FIG. 15, the display data provided to first pixel memory unit PMU1(1) is denoted by character DATA1, and the display data provided to second pixel memory unit PMU2(1) is denoted by character DATA2. Moreover, the flip-flops included in first pixel memory units PMU1(1) to PMU1(9) constitute one shift register, and the flip-flops included in second pixel memory units PMU2(1) to PMU2(9) constitute another shift register. That is, in the present variant, two line shift registers are provided.

In such a configuration, as in the above-described embodiment, one-bit data is held in each of the flip-flops within first pixel memory units PMU1(1) to PMU1(9) and each of the flip-flops within second pixel memory units PMU2(1) to PMU2(9), so that for each pixel, the display state of the subpixel that corresponds to the first pixel memory unit PMU1 (referred to below as a "first subpixel") can be controlled independently of the display state of the subpixel that corresponds to the second pixel memory unit PMU2 (referred to below as a "second subpixel"). Thus, the present variant enables halftone display.

Figure 16A:
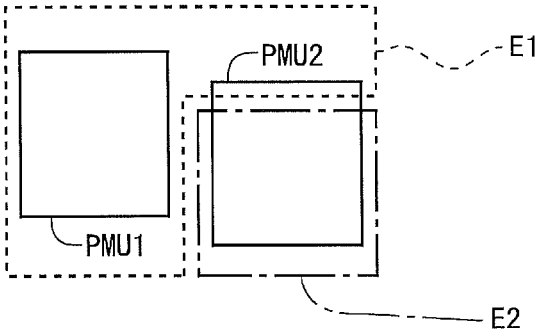
FIGS. 16A and 16B are diagrams illustrating an example where pixel electrodes in two subpixels have different areas in the third variant of the embodiment.
Figure 16B:
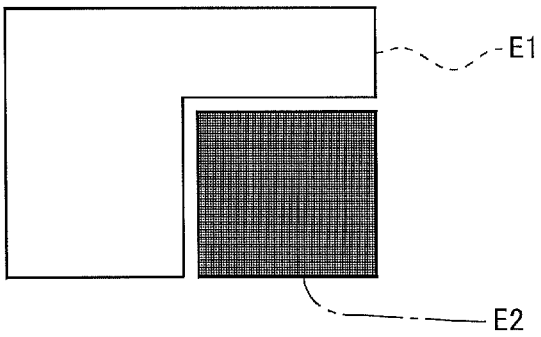

Incidentally, by variably setting the area ratio of the pixel electrode that forms the first subpixel to the pixel electrode that forms the second subpixel, it is rendered possible to achieve various halftone display by area gradation. For example, a pixel electrode E1, which forms a first subpixel, and a pixel electrode E2, which forms a second subpixel, can be formed on a panel substrate as shown in FIG. 16A. In this case, a voltage based on data held in the flip-flop within the first pixel memory unit PMU1 is applied to the pixel electrode E1, and a voltage based on data held in the flip-flop within the second pixel memory unit PMU2 is applied to the pixel electrode E2. In the case where white display voltage VW is applied to the pixel electrode E1, and black display voltage VBL is applied to the pixel electrode E2, the display states of the pixels are as shown in FIG. 16B. Here, white display voltage VW can be applied to both of the pixel electrodes E1 and E2. Alternatively, black display voltage VBL can be applied to both of the pixel electrodes E1 and E2. Furthermore, it is also possible to apply black display voltage VBL to the pixel electrode E1 and white display voltage VW to the pixel electrode E2. In this manner, by setting the area of the pixel electrode E1 and the area of the pixel electrode E2 to differ from each other, it is rendered possible to achieve gradation display in four-levels of gradations.

Figure 17A:
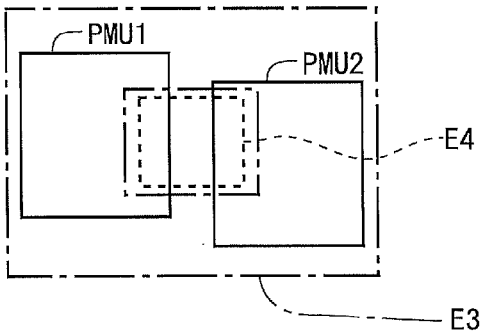
FIGS. 17A and 17B are diagrams illustrating an example where pixel electrodes in two subpixels have different areas in the third variant of the embodiment.
Figure 17B:
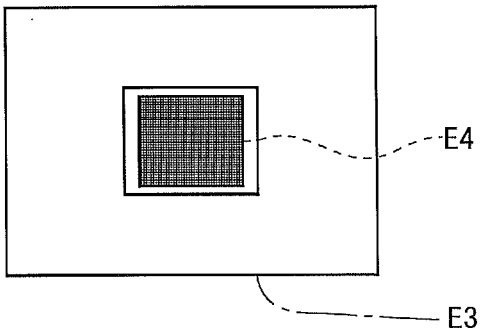

Furthermore, for example, a pixel electrode E3, which forms a first subpixel, and a pixel electrode E4, which forms a second subpixel, can be formed on a panel substrate such that the pixel electrode E4 is enclosed by the pixel electrode E3 as shown in FIG. 17A. Here, when white display voltage VW is applied to the pixel electrode E3, and black display voltage VBL is applied to the pixel electrode E4, the display states of the pixels are as shown in FIG. 17B.

Note that the configuration of subpixels within one pixel is not limited to the above examples. For example, one pixel may be configured by three or more subpixels. Moreover, as for a plurality of pixel electrodes which form a plurality of subpixels, the area ratio and the positional relationship can be variably set.

Furthermore, in a display device in which color filters are formed and in a display device which has a color display function (e.g., an organic EL display device), one pixel may be configured by three subpixels, and R (red), G (green), and B (blue) data may be respectively provided to three line shift registers corresponding to the three subpixels. This enables color display.

<5.4 Fourth Variant>

In the embodiment, upon each input of one-bit data to flip-flop 11(1) as display data DATA, an image displayed by nine pixels changes. Such a change in the image is perceived as noise. Therefore, in the present variant, circuits (referred to below as "white display circuits") are provided in order to set the display states of all pixels to white display until the time when the first latch portions 111 within all of the flip-flops hold their respective corresponding data therein. Note that in the present variant, the white display circuits realize white display function portions.

Figure 18:
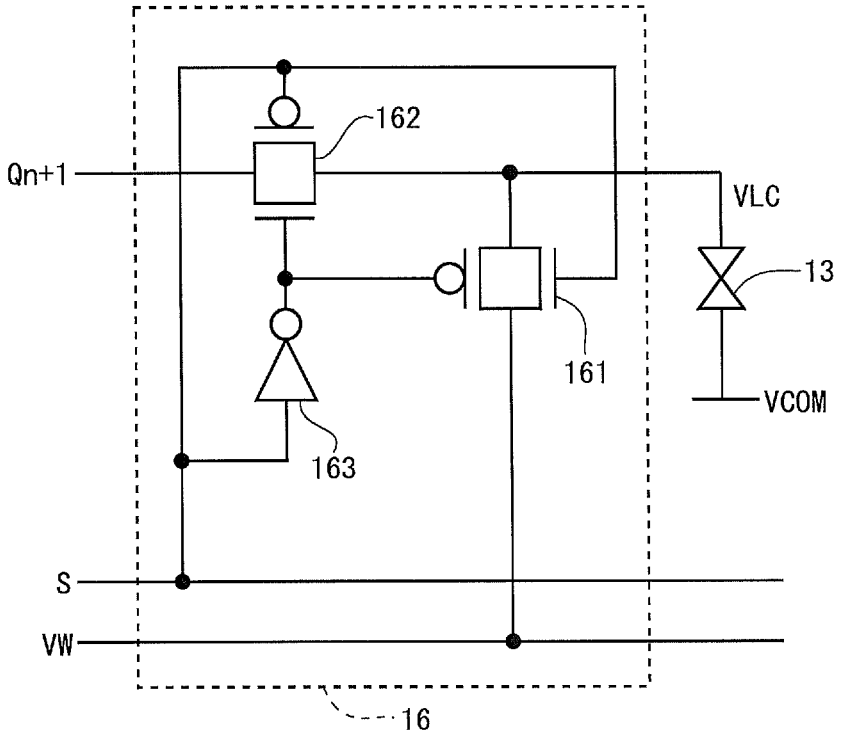
FIG. 18 is a circuit diagram illustrating a specific configuration example of a white display circuit in a fourth variant of the embodiment.

FIG. 18 is a circuit diagram illustrating a specific configuration example of the white display circuit 16. The white display circuit 16 includes two CMOS switches 161 and 162, each consisting of a P-type TFT and an N-type TFT, and an inverter 163. The CMOS switch 161 has an input terminal to which white display voltage VW is provided and an output terminal connected to the pixel electrode. An instruction signal S is provided to a gate terminal of the N-type TFT in the CMOS switch 161, and a gate terminal of the P-type TFT in the CMOS switch 161 is connected at to an output terminal of the inverter 163. The CMOS switch 162 has an input terminal to which signal Qn+1 is provided and an output terminal connected to the pixel electrode. A gate terminal of the N-type TFT in the CMOS switch 162 is connected to the output terminal of the inverter 163, and the instruction signal S is provided to a gate terminal of the P-type TFT in the CMOS switch 162. The inverter 163 has an input terminal to which the instruction signal S is provided and the output terminal connected to the gate terminal of the P-type TFT in the CMOS switch 161 and the gate terminal of the N-type TFT in the CMOS switch 162.

In the above configuration, when the instruction signal S is at high level, the CMOS switch 161 is brought into ON state and the CMOS switch 162 is brought into OFF state. As a result, white display voltage VW is provided to the pixel electrodes. On the other hand, when the instruction signal S is at low level, the CMOS switch 161 is brought into OFF state, and the CMOS switch 162 is brought into ON state. As a result, signals Qn+1 (output signals Q1 to Q9 of the flip-flops) are provided to the pixel electrodes.

Here, until the time when the first latch portions 111 within all of the flip-flops hold their respective corresponding data therein (the period being from time t1 to time t9 in FIGS. 7 and 11), the instruction signal is set at high level, and thereafter (after time t9 in FIGS. 7 and 11), the instruction signal is set at low level. Therefore, when an image is displayed or the contents of the image change, the image to be displayed is presented after full-screen white display is performed. As a result, noise can be barely perceived.

<5.5 Fifth Variant>

Figure 19:
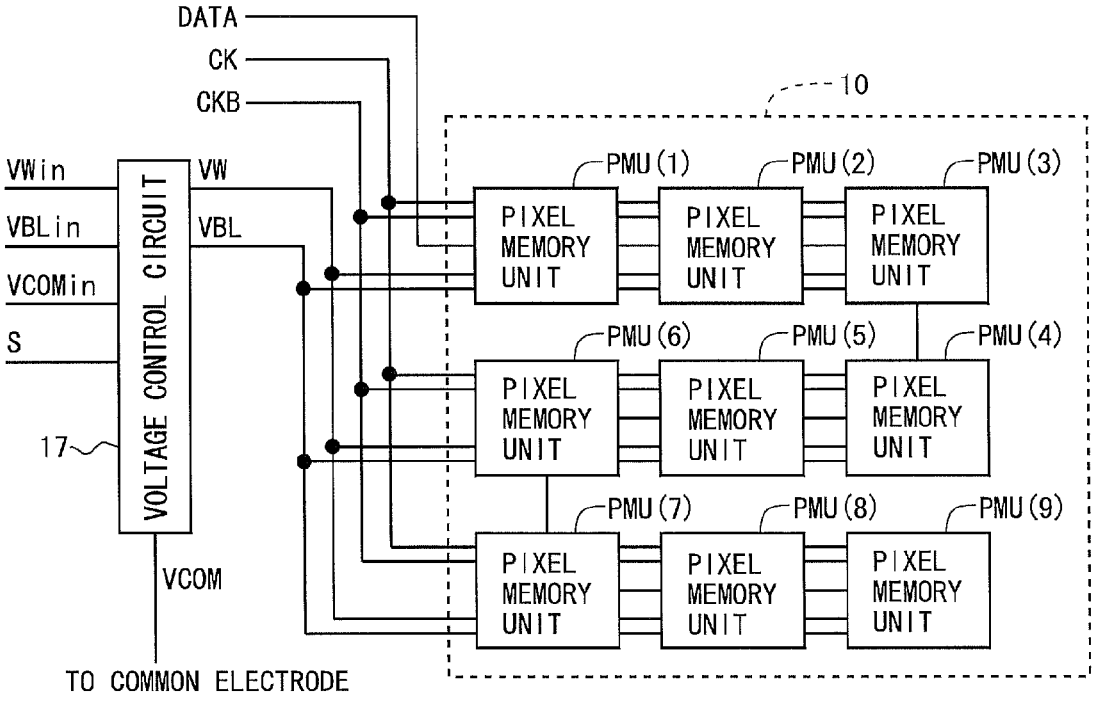
FIG. 19 is a block diagram illustrating the configurations of a pixel memory portion and a voltage control circuit in a fifth variant of the embodiment.

In the fourth variant, the white display circuit 16 is provided for each pixel in the pixel memory portion 10. On the other hand, in the present variant, as a component for setting the display states of all of the pixels to white display, a voltage control circuit 17 is provided outside the pixel memory portion 10, as shown in FIG. 19. White display voltage VWin, black display voltage VBLin, common electrode voltage VCOMin, and a control signal S are inputted into the voltage control circuit 17. On the basis of the control signal S, the voltage control circuit 17 outputs white display voltage VW, black display voltage VBL, and common electrode voltage VCOM.

Figure 20:
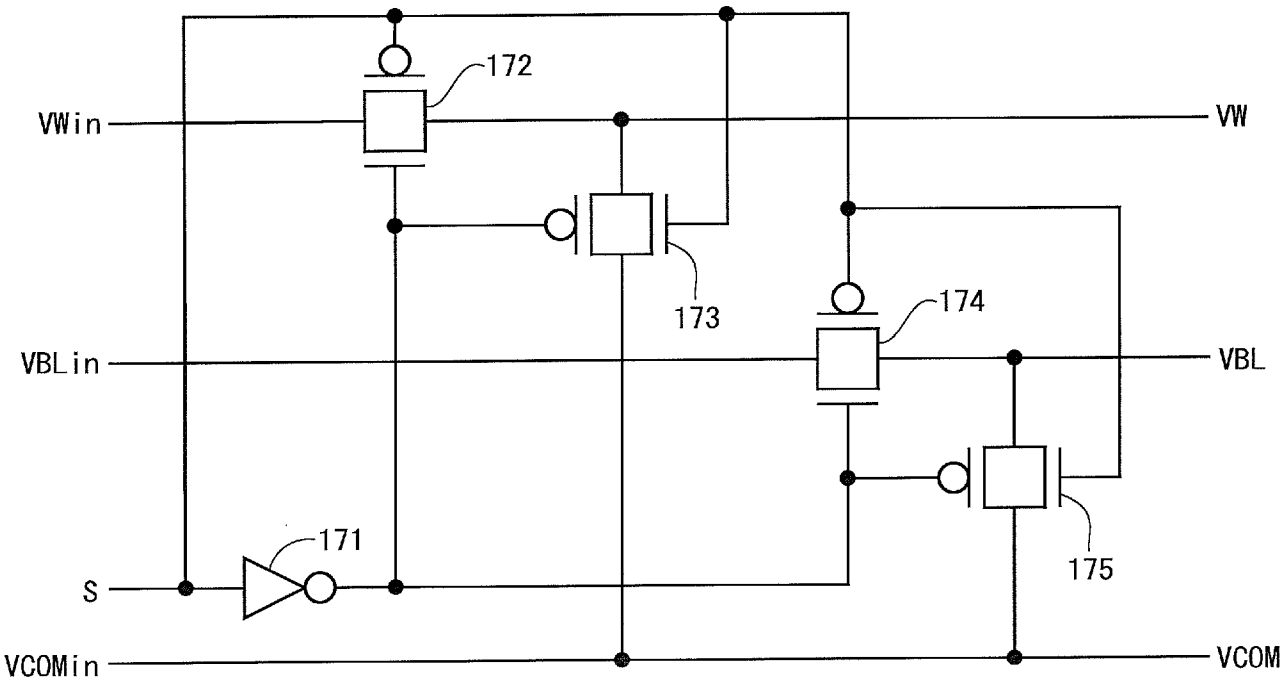
FIG. 20 is a circuit diagram illustrating a specific configuration example of the voltage control circuit in the fifth variant of the embodiment.

FIG. 20 is a circuit diagram illustrating a specific configuration example of the voltage control circuit 17. The voltage control circuit 17 includes an inverter 171 and four CMOS switches 172 to 175, each consisting of a P-type TFT and an N-type TFT. The inverter 171 has an input terminal to which a control signal S is provided and an output terminal connected to a gate terminal of the N-type TFT in the CMOS switch 172, a gate terminal of the P-type TFT in the CMOS switch 173, a gate terminal of the N-type TFT in the CMOS switch 174, and a gate terminal of the P-type TFT in the CMOS switch 175. The CMOS switch 172 has an input terminal to which white display voltage VWin is provided and an output terminal connected to wiring for transmitting white display voltage VW. The gate terminal of the N-type TFT in the CMOS switch 172 is connected to the output terminal of the inverter 171, and the control signal S is provided to a gate terminal of the P-type TFT in the CMOS switch 172. The CMOS switch 173 has an input terminal to which common electrode voltage VCOMin is provided and an output terminal connected to wiring for transmitting white display voltage VW. The gate terminal of the P-type TFT in the CMOS switch 173 is connected to the output terminal of the inverter 171, and the control signal S is provided to a gate terminal of the N-type TFT in the CMOS switch 173. The CMOS switch 174 has an input terminal to which black display voltage VBLin is provided and an output terminal connected to wiring for transmitting black display voltage VBL. The gate terminal of the N-type TFT in the CMOS switch 174 is connected to the output terminal of the inverter 171, and the control signal S is provided to a gate terminal of the P-type TFT in the CMOS switch 174. The CMOS switch 175 has an input terminal to which common electrode voltage VCOMin is provided and an output terminal connected to wiring for transmitting black display voltage VBL. The gate terminal of the P-type TFT in the CMOS switch 175 is connected to the output terminal of the inverter 171, and the control signal S is provided to a gate terminal of the N-type TFT in the CMOS switch 175.

In the above configuration, when the control signal S is at high level, the CMOS switches 173 and 175 are brought into ON state, and the CMOS switches 172 and 174 are brought into OFF state. As a result, common electrode voltage VCOMin is provided to the pixel memory portion 10 as white display voltage VW, and common electrode voltage VCOMin is provided to the pixel memory portion 10 as black display voltage VBL. At this time, white display voltage VW, black display voltage VBL, and common electrode voltage VCOM are equal in magnitude (potential), and therefore in a liquid crystal display device employing the normally white mode, the display states of all pixels are set to white display. On the other hand, when the control signal S is at low level, the CMOS switches 172 and 174 are brought into ON state, and the CMOS switches 173 and 175 are brought into OFF state. As a result, white display voltage VWin is provided to the pixel memory portion 10 as white display voltage VW, and black display voltage VBLin is provided to the pixel memory portion 10 as black display voltage VBL. At this time, the display states of the pixels are based on data held in the flip-flops. Note that in a liquid crystal display device employing the normally black mode, when the control signal S is at high level, the display states of all pixels are set to black display.

Figure 21:
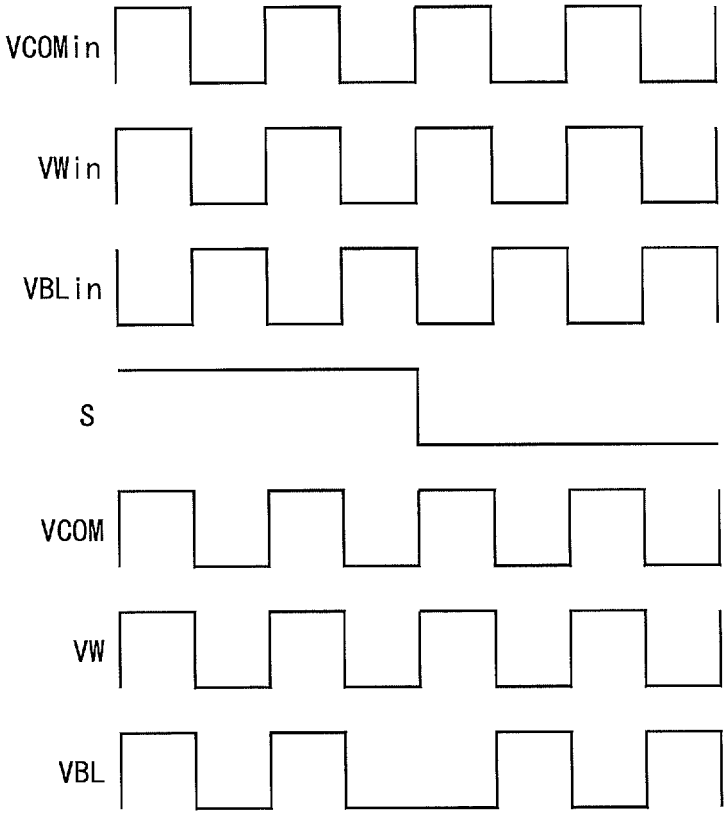
FIG. 21 is a signal waveform chart describing the operation of the voltage control circuit in the fifth variant of the embodiment.

Here, until the time when the first latch portions 111 (see FIG. 5) within all of the flip-flops hold their respective corresponding data, the control signal S may be set at high level, and thereafter, the control signal S may be set at low level, as shown in FIG. 21. As a result, as in the fourth variant, when an image is displayed or the contents of the image change, the image to be displayed is presented after full-screen white display is performed. Thus, noise can be barely perceived. Moreover, in the present variant, it is not necessary for each pixel to be provided with a circuit for setting the display state of the pixel to white display, so that the display states of the pixels can be controlled with a relatively simplified configuration.

<5.6 Sixth Variant>

Figure 22:
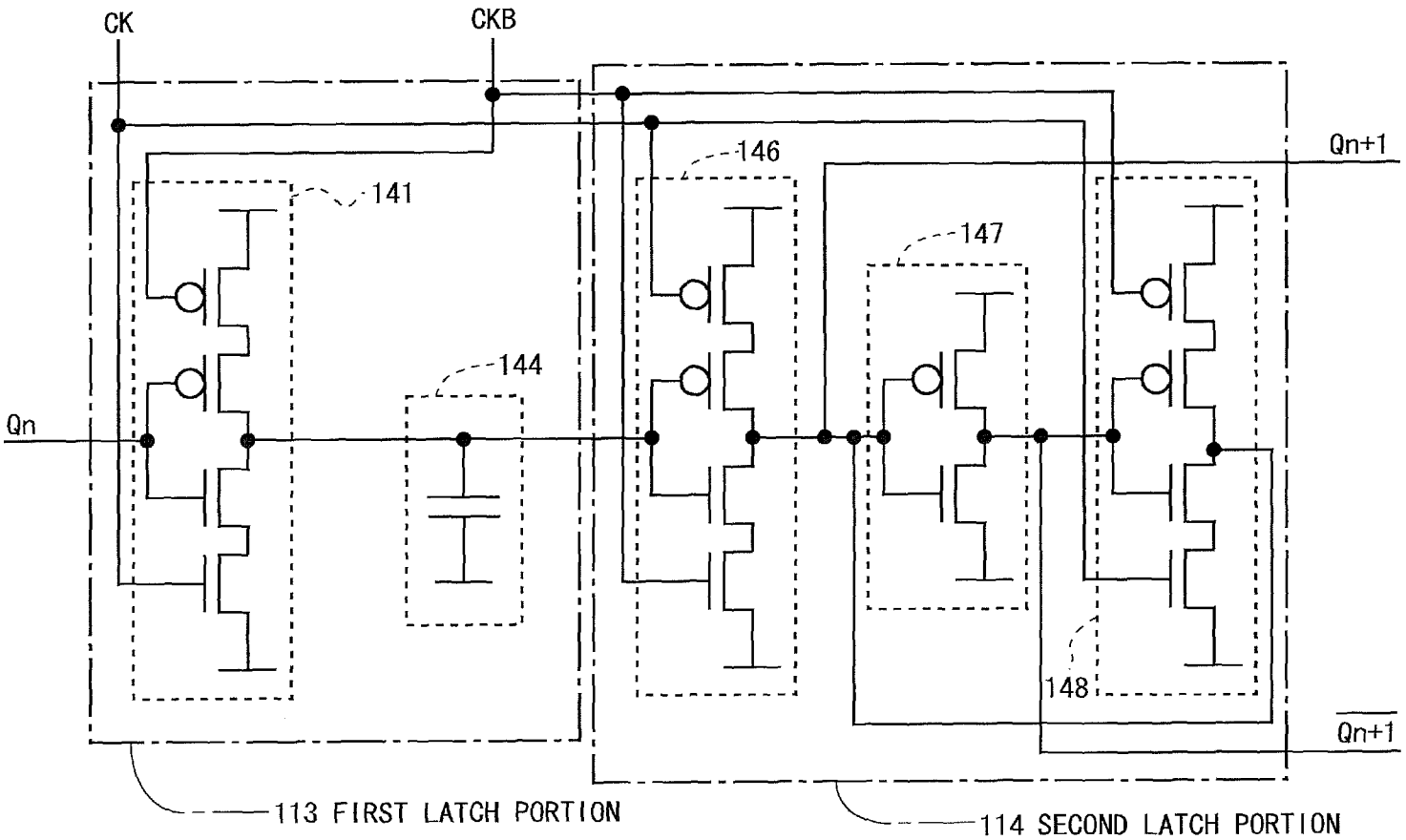
FIG. 22 is a circuit diagram illustrating a specific configuration example of a flip-flop in a sixth variant of the embodiment.
Figure 23:
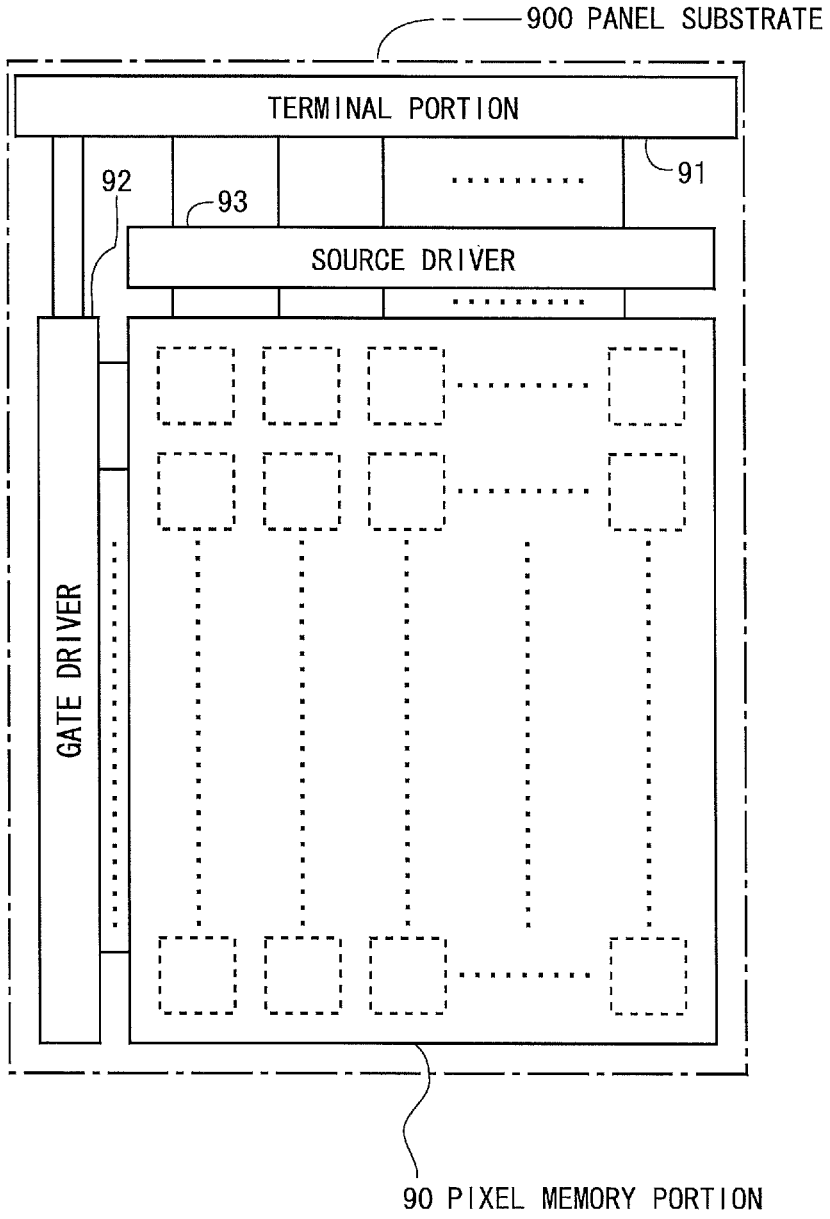
Fig.23 PRIOR ART
FIG. 23 is a block diagram illustrating a schematic configuration of a conventional memory liquid crystal display.
Figure 24:
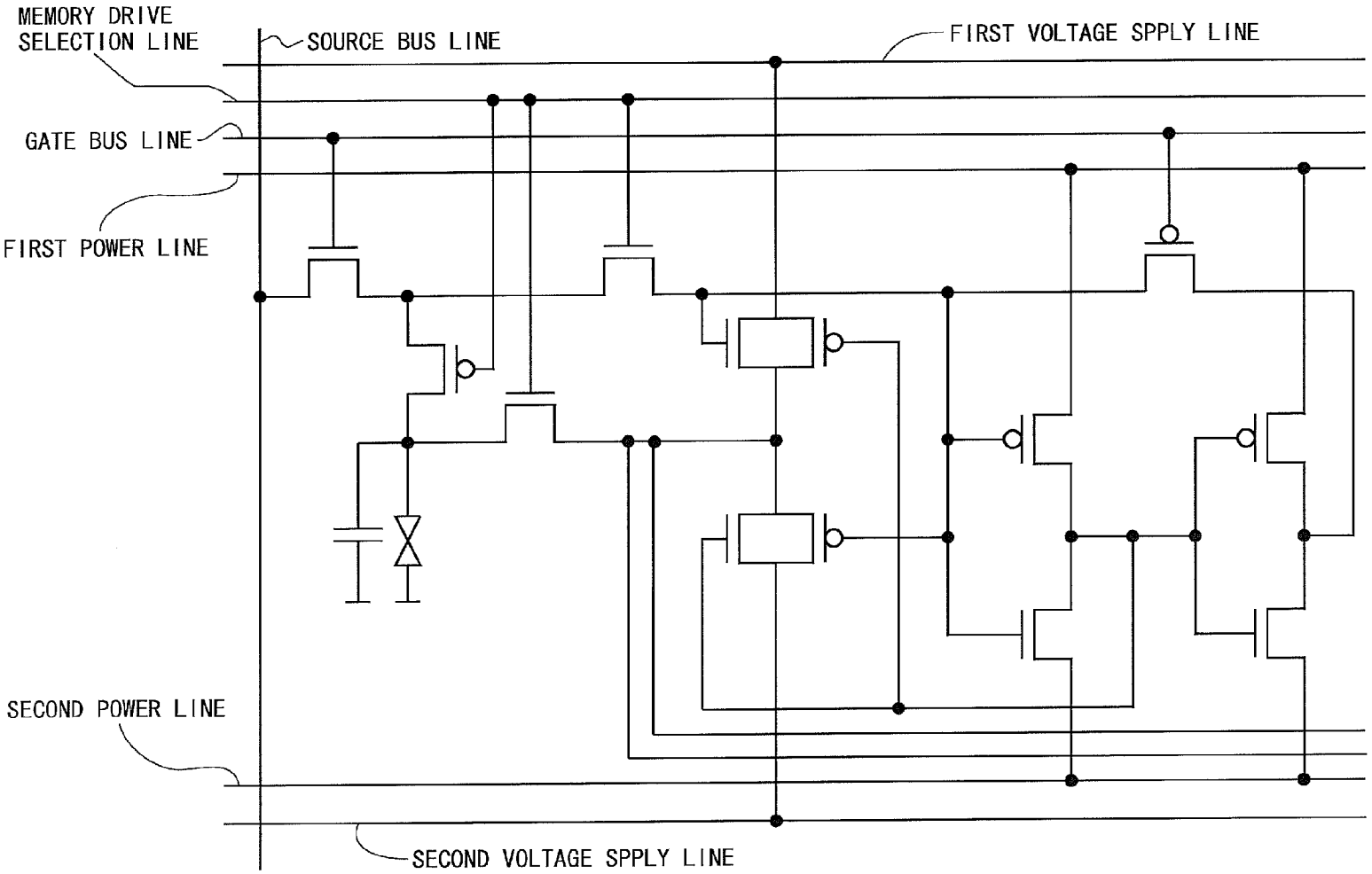
Fig.24 PRIOR ART
FIG. 24 is a circuit diagram illustrating the configuration of a pixel memory circuit in a display device disclosed in Japanese Laid-Open Patent Publication No. 2007-286237.

FIG. 22 is a circuit diagram illustrating a specific configuration example of a flip-flop in a sixth variant of the embodiment. As in the embodiment, the flip-flop is configured by a first latch portion 113 for taking in signal Qn and holding it as transfer data, and a second latch portion 114 for taking in the transfer data and holding it as output data, and for outputting signals Qn+1 and Qn+1B on the basis of the output data.

The first latch portion 113 includes a first clocked inverter 141 in which signal Qn is provided to an input terminal, and a capacitance 144 in which one end is connected to an output terminal of the first clocked inverter 141 and the other end is grounded. Note that the output terminal of the first clocked inverter 141 is also connected to an input terminal of a third clocked inverter 146 to be described later.

The second latch portion 114 is configured by the third clocked inverter 146, which is connected at the input terminal to the output terminal of the first clocked inverter 141, a second inverter 147, which is connected at an input terminal to an output terminal of the third clocked inverter 146, and a fourth clocked inverter 148, which is connected at an input terminal to an output terminal of the second inverter 147 and is also connected at an output terminal to the input terminal of the second inverter 147. Note that signal Qn+1 is outputted from the output terminal of the third clocked inverter 146, and signal Qn+1B is outputted from the output terminal of the second inverter 147.

With the configuration as described above, in this flip-flop, a charge is accumulated in the capacitance 144 in accordance with the value of signal Qn being provided during a period in which the clock signal CK is at high level and the clock signal CKB is at low level. In the present variant, the difference in potential between the ends of the capacitance 144 due to charge accumulation functions as transfer data. Thereafter, at the time when the clock signal CK changes from high level to low level, and the clock signal CKB changes from low level to high level, the value of signal Qn held in the first latch portion 113 as transfer data appears as the waveform of signal Qn+1. Moreover, since the transfer data is held in the second latch portion 114, the waveform of signal Qn+1 is maintained until the next time the clock signal CK changes from high level to low level and the clock signal CKB changes from low level to high level.

In the present variant, the number of transistors included in the first latch portion 113 is six less than in the above-described embodiment. Thus, it is possible to inexpensively provide a display device capable of further reducing a circuit area on a panel substrate and realizing low power consumption by drive using memory.

<6. Other>

While the embodiment has been described taking the liquid crystal display device as an example, the present invention is not limited to this. The present invention can also be applied to other display devices such as organic EL (electroluminescence) display devices.

DESCRIPTION OF THE REFERENCE CHARACTERS

10 pixel memory portion
11, 11(1) to 11(9) flip-flop
12 voltage selection portion
13 liquid crystal capacitance
16 white display circuit
17 voltage control circuit
19 terminal portion
100 panel substrate
111, 113 first latch portion
112, 114 second latch portion
200 pixel memory drive portion
PMU, PMU(1) to PMU(9) pixel memory unit
CK, CKB clock signal
VBL black display voltage
VW white display voltage
VCOM common electrode voltage
VLC pixel electrode voltage

The invention claimed is:

1. A display device, comprising:

a shift register including m flip-flops provided in respective pixel areas of m pixels where m is a positive integer, specific ones of the flip-flops being connected in series so as to sequentially transfer input data in accordance with clock signals;

voltage selection portions provided so as to correspond to their respective flip-flops, each of the voltage selection portions selecting one of a white display signal and a black display signal in accordance with a logic value of an output signal from each of the flip-flops;

display element portions provided so as to correspond to their respective flip-flops, each of the display element portions reflecting the voltage selected by the voltage selection portion in the display state of the pixel that corresponds to each of the flip-flops; and a voltage control circuit that controls a waveform of input signals based on a control signal, wherein in each of the display element portions, the display state of the pixel changes based on a difference between the one of the white display signal and the black display signal selected by the voltage selection portion and a common electrode signal, the voltage control circuit receives a white display input signal, a black display input signal, and a common electrode input signal as the input signals, a waveform of one of the white display input signal and the black display input signal is same as a waveform of the common electrode input signal, and another of the white display input signal and the black display input signal is same as an inverted waveform of the common electrode input signal, the voltage control circuit outputs the white display signal, the black display signal, and the common electrode signal such that all of the white display signal, the black display signal, and the common electrode signal have an identical waveform when the control signal is at a first level, and the voltage control circuit outputs the white display input signal as the white voltage signal, the black display input signal as the black display signal, and the common electrode input signal as the common electrode signal when the control signal is at a prescribed second level which is different from the first level.

2. The display device according to claim 1, wherein each of the flip-flops includes:

a first latch portion for taking in an input signal and holding it as transfer data; and a second latch portion for taking in the transfer data and holding it as output data and outputting the output signal on the basis of the output data.

3. The display device according to claim 2, wherein, the first latch portion includes:

a first clocked inverter having an input terminal to which the input signal is provided, and operating in accordance with the clock signals;

a first inverter connected at an input terminal to an output terminal of the first clocked inverter; and a second clocked inverter connected at an input terminal to an output terminal of the first inverter and connected at an output terminal to the input terminal of the first inverter, and operating in accordance with the clock signals, and the second latch portion includes:

a third clocked inverter connected at an input terminal to the output terminal of the first inverter and operating in accordance with the clock signals;

a second inverter connected at an input terminal to an output terminal of the third clocked inverter; and a fourth clocked inverter connected at an input terminal to an output terminal of the second inverter and connected at an output terminal to the input terminal of the second inverter, and operating in accordance with the clock signals, and the output signal is outputted from the output terminal of the second inverter.

4. The display device according to claim 2, wherein, the first latch portion includes:

a first clocked inverter having an input terminal to which the input signal is provided, and operating in accordance with the clock signals; and a capacitance having one end to which an output terminal of the first clocked inverter is connected and having the other end to which a predetermined potential is provided, the second latch portion includes:

a third clocked inverter connected at an input terminal to the output terminal of the first clocked inverter and operating in accordance with the clock signals;

a second inverter connected at an input terminal to an output terminal of the third clocked inverter; and a fourth clocked inverter connected at an input terminal to an output terminal of the second inverter and connected at an output terminal to the input terminal of the second inverter, and operating in accordance with the clock signals, and the output signal is outputted from the output terminal of the second inverter.

5. The display device according to claim 2, wherein, m pieces of data corresponding to the m flip-flops are provided to the shift register as the input data, and the clock signals stop their action after the m pieces of data are held as the transfer data in the first latch portions included in the corresponding flip-flops.

6. The display device according to claim 1, wherein, each of the pixels is composed of n subpixels where n is an integer of 2 or more, the flip-flops are provided so as to respectively correspond to the n subpixels included in the pixels, n shift registers are provided such that, for each pixel, the n flip-flops corresponding to that pixel constitute a different shift register from one another, and to the n shift registers, different data are provided from one another as the input data.

7. The display device according to claim 6, wherein n pixel electrodes forming the n subpixels included in each pixel are different in area.

8. The display device according to claim 6, wherein, each of the pixels is composed of three subpixels respectively corresponding to red, green, and blue, and red data, green data, and blue data are provided as the input data respectively to three shift registers respectively corresponding to the three subpixels.

9. The display device according to claim 1, wherein, any flip-flop of the m flip-flops is connected in series with at least one other flip-flop of the m flip-flops.

10. The display device according to claim 1, wherein, a display data inputted to a first flip-flop of the m flip-flops is sequentially transmitted to subsequent flip-flops of the m flip-flops in accordance with the clock signals.

11. The display device according to claim 1, wherein, the m pixels and the m flip-flops are arranged in matrix of i rows×j columns, neighboring flip-flops in each of the i rows are connected to each other, and in any three consecutive rows, the flip-flop in the first row, j'th column is connected to the flip-flop in the second row, j'th column, and the flip-flop in the second row, first column is connected to the flip-flop in the third row, first column, or the flip-flop in the first row, first column is connected to the flip-flop in the second row, first column, and the flip-flop in the second row, j'th column is connected to the flip-flop in the third row, j'th column.

12. The display device according to claim 1, wherein, the m pixels and the m flip-flops are arranged in matrix of i rows×j columns, neighboring flip-flops in each of the i rows are connected to each other, and in any two consecutive rows, the flip-flop in the first row, j'th column is connected to the flip-flop in the second row, first column.

13. The display device according to claim 1, wherein the voltage control circuit outputs the common electrode input signal as all of the white display signal, the black display signal, and the common electrode signal when the control signal is at the first level.

* * * * *